US006151011A

United States Patent [19]

Worley, III et al.

[11] Patent Number: 6,151,011

[45] Date of Patent: Nov. 21, 2000

[54] SYSTEM AND METHOD FOR USING COMPOUND DATA WORDS TO REDUCE THE DATA PHASE DIFFERENCE BETWEEN ADJACENT PIXEL ELECTRODES

[75] Inventors: W. Spencer Worley, III, Half Moon Bay; Edwin Lyle Hudson, Los Altos; William Thomas Weatherford, San Mateo; Wing Hong Chow, San Jose, all of Calif.

[73] Assignee: Aurora Systems, Inc., San Jose, Calif.

[21] Appl. No.: 09/032,174

[22] Filed: Feb. 27, 1998

[51] Int. Cl.[7] ..... G09G 5/10

[52] U.S. Cl. ..... 345/147; 345/148

[58] Field of Search ..... 345/148, 147, 345/87, 89, 94, 99, 204, 208

[56] References Cited

U.S. PATENT DOCUMENTS

| | | | |
|---|---|---|---|
| 5,497,172 | 3/1996 | Doherty et al. | 345/85 |
| 5,619,228 | 4/1997 | Doherty | 345/147 |
| 5,731,802 | 3/1998 | Aras et al. | 345/147 |
| 5,969,710 | 10/1999 | Doherty et al. | 345/147 |
| 5,986,640 | 11/1999 | Baldwin et al. | 345/147 |

*Primary Examiner*—Regina Liang
*Attorney, Agent, or Firm*—Henneman & Saunders; Larry E. Henneman, Jr.

[57] ABSTRACT

A system and method for reducing the phase difference between adjacent gray scale values employ compound data words. The compound data words include a first group of data bits and a second group of data bits. A display driver circuit is configured to provide display control signals causing each bit of the first group of data bits to be asserted on the display pixel for a coequal time period, and causing each bit of the second group of data bits to be asserted on the display pixel for a time period dependent on an associated significance of each bit. Optionally, the display driver circuit further includes a compound data generator configured to provide the compound data words. A method for asserting a compound data word on a display pixel includes the steps of asserting each bit of the first group of bits on the display pixel for a coequal time period, and asserting each bit of the second group of bits on the display pixel for a time period dependent on an associated significance of each bit.

65 Claims, 14 Drawing Sheets

Microfiche Appendix Included
(2 Microfiche, 114 Pages)

| Gray Scale Values | Bits B7-B0 | Out of Phase |
|---|---|---|
| 000 | 0000 0000 | |
| . | . | |
| 015 | 0000 1111 | |
| 016 | 0001 0000 | 31/255 |
| . | . | |
| 031 | 0001 1111 | |
| 032 | 0010 0000 | 63/255 |
| . | . | |
| 047 | 0010 1111 | |
| 048 | 0011 0000 | 31/255 |
| . | . | |
| 063 | 0011 1111 | |
| 064 | 0100 0000 | 127/255 |
| . | . | |
| 079 | 0100 1111 | |
| 080 | 0101 0000 | 31/255 |
| . | . | |
| 095 | 0101 1111 | |
| 096 | 0110 0000 | 63/255 |
| . | . | |
| 111 | 0110 1111 | |
| 112 | 0111 0000 | 31/255 |
| . | . | |
| 127 | 0111 1111 | |
| 128 | 1000 0000 | 255/255 |
| . | . | |

| Gray Scale Values | Bits B7-B0 | Out of Phase |
|---|---|---|
| 143 | 1000 1111 | |
| 144 | 1001 0000 | 31/255 |
| . | . | |
| 159 | 1001 1111 | |
| 160 | 1010 0000 | 63/255 |
| . | . | |
| 175 | 1010 1111 | |
| 176 | 1011 0000 | 31/255 |
| . | . | |
| 191 | 1011 1111 | |
| 192 | 1100 0000 | 127/255 |
| . | | |
| 207 | 1100 1111 | |
| 208 | 1101 0000 | 31/255 |
| . | . | |
| 223 | 1101 1111 | |
| 224 | 1110 0000 | 63/255 |
| . | . | |
| 239 | 1110 1111 | |
| 240 | 1111 0000 | 31/255 |
| . | . | |
| 255 | 1111 1111 | |

FIG. 4
Prior Art

FIG. 6A

| Gray Scale Values | B8'-B6:B5-B0 | Out of Phase |
|---|---|---|
| 000 | 000 000000 | |
| . | . | |
| 063 | 000 111111 | 127/255 |
| 064 | 001 000000 | |
| . | . | |
| 127 | 001 111111 | 127/255 |
| 128 | 011 000000 | |
| . | . | |
| 191 | 011 111111 | 127/255 |
| 192 | 111 000000 | |
| . | . | |
| 255 | 111 111111 | |

FIG. 6B

| Gray Scale Values | B11'-B5: B4-B0 | Out of Phase |
|---|---|---|
| 000 | 0000000 00000 | |
| . | . | |
| 031 | 0000000 11111 | |
| 032 | 0000001 00000 | 63/255 |
| . | . | |
| 063 | 0000001 11111 | |
| 064 | 0000011 00000 | 63/255 |
| . | . | |
| 095 | 0000011 11111 | |
| 096 | 0000111 00000 | 63/255 |
| . | | |
| 127 | 0000111 11111 | |
| 128 | 0001111 00000 | 63/255 |
| . | . | |
| 159 | 0001111 11111 | |
| 160 | 0011111 00000 | 63/255 |
| . | . | |
| 191 | 0011111 11111 | |
| 192 | 0111111 00000 | 63/255 |
| . | . | |
| 223 | 0111111 11111 | |
| 224 | 1111111 00000 | 63/255 |
| . | . | |
| 255 | 1111111 11111 | |

| Gray Scale Values | B9-B4:B3-B0 | Out of Phase |
|---|---|---|
| 000 | 000000 0000 | |
| . | . | |
| 015 | 000000 1111 | |
| 016 | 000001 0000 | 31/111 |
| . | . | |
| 031 | 000001 1111 | |
| 032 | 000011 0000 | 31/111 |
| . | . | |
| 047 | 000011 1111 | |
| 048 | 000111 0000 | 31/111 |
| . | . | |
| 063 | 000111 1111 | |
| 064 | 001111 0000 | 31/111 |
| . | . | |
| 079 | 001111 1111 | |
| 080 | 011111 0000 | 31/111 |
| . | . | |
| 095 | 011111 1111 | |
| 096 | 111111 0000 | 31/111 |
| . | . | |
| 111 | 111111 1111 | |

FIG. 7

| Total Bits | E.W. Bits | B.W. Bits | # Gray Levels | Max. Phase Difference | Approx. Difference |
|---|---|---|---|---|---|
| 8 | 6 | 2 | 28 | 7/27 | 0.259 |
| | 5 | 3 | 48 | 15/47 | 0.319 |
| | 4 | 4 | 80 | 31/79 | 0.392 |
| | 3 | 5 | 128 | 63/127 | 0.496 |
| 9 | 7 | 2 | 32 | 7/31 | 0.226 |
| | 6 | 3 | 56 | 15/55 | 0.273 |
| | 5 | 4 | 96 | 31/95 | 0.326 |
| | 4 | 5 | 160 | 63/159 | 0.396 |
| 10 | 8 | 2 | 36 | 7/35 | 0.200 |
| | 7 | 3 | 64 | 15/63 | 0.238 |
| | 6 | 4 | 112 | 31/111 | 0.279 |
| | 5 | 5 | 192 | 63/191 | 0.330 |

FIG. 8

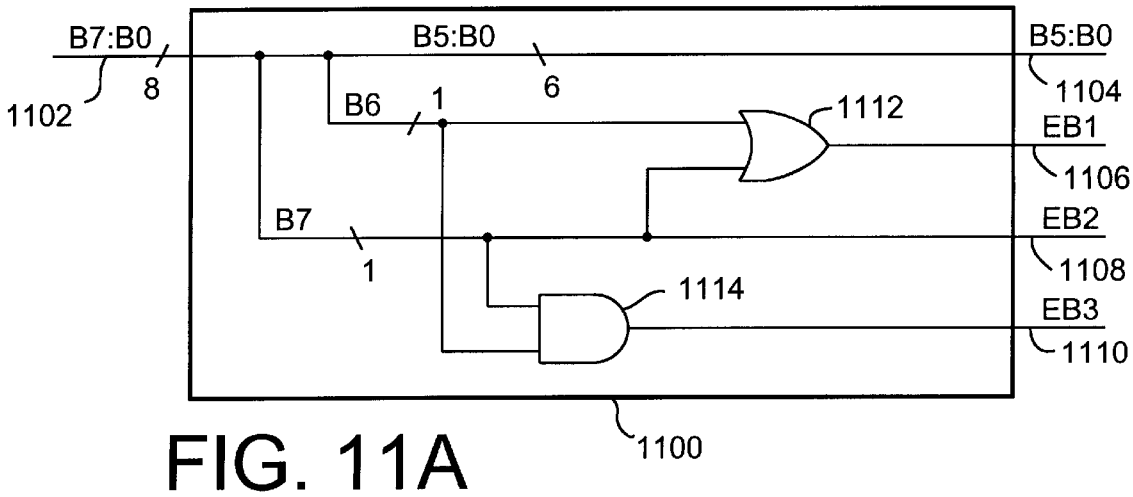
FIG. 11A
FIG. 11B
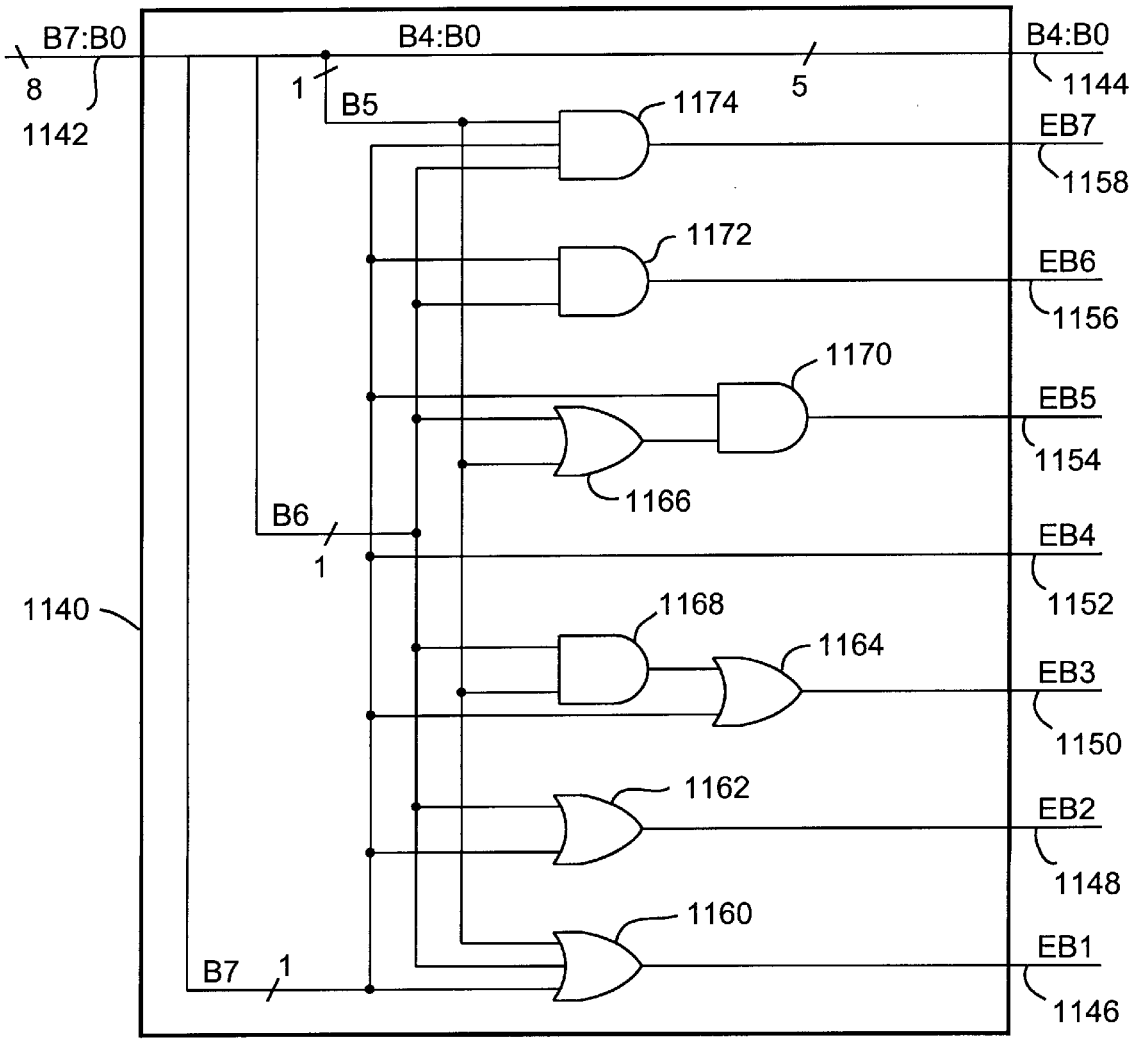

SYSTEM AND METHOD FOR USING COMPOUND DATA WORDS TO REDUCE THE DATA PHASE DIFFERENCE BETWEEN ADJACENT PIXEL ELECTRODES

CROSS-REFERENCE TO MICROFICHE APPENDIX

The microfiche appendix, which is a part of the present disclosure, contains two (2) sheets of microfiche having one-hundred and fourteen (114) frames, and provides verilog code for implementing a particular embodiment of the present invention. A portion of the disclosure of this patent document contains material which is subject to copyright protection. The copyright owner has no objection to the facsimile reproduction by anyone of the patent document or the patent disclosure, as it appears on the Patent and Trademark Office patent files or records, but otherwise reserves all copyright rights.

BACKGROUND OF THE INVENTION

1. Field of the Invention

This invention relates generally to electronic driver circuits, and more particularly to a novel circuit and method for using compound data words to drive a display.

2. Description of the Background Art

FIG. 1 shows a single pixel cell 100 of a typical liquid crystal display. Pixel cell 100 includes a liquid crystal layer 102, contained between a transparent common electrode 104 and a pixel storage electrode 106, and a storage element 108. Storage element 108 includes complementary data input terminals 110 and 112, data output terminal 114, and a control terminal 116. Responsive to a write signal on control terminal 116, storage element 108 reads complementary data signals asserted on a pair of bit lines (B+ and B−) 118 and 120, and latches the signal on output terminal 114 and coupled pixel electrode 106.

Liquid crystal layer 102 rotates the polarization of light passing through it, the degree of rotation depending on the root-mean-square (RMS) voltage across liquid crystal layer 102. The ability to rotate the polarization is exploited to modulate the intensity of reflected light as follows. An incident light beam 122 is polarized by polarizer 124. The polarized beam then passes through liquid crystal layer 102, is reflected off of pixel electrode 106, and passes again through liquid crystal layer 102. During this double pass through liquid crystal layer 102, the beam's polarization is rotated by an amount which depends on the data signal being asserted on pixel storage electrode 106. The beam then passes through polarizer 126, which passes only that portion of the beam having a specified polarity. Thus, the intensity of the reflected beam passing through polarizer 126 depends on the amount of polarization rotation induced by liquid crystal layer 102, which in turn depends on the data signal being asserted on pixel storage electrode 106.

Storage element 108 can be either an analog storage element (e.g. capacitative) or a digital storage element (e.g., SRAM latch). In the case of a digital storage element, a common way to drive pixel storage electrode 106 is via pulse-width-modulation (PWM). In PWM, different gray scale levels are represented by multi-bit words (i.e., binary numbers). The multi-bit words are converted to a series of pulses, whose time-averaged root-mean-square (RMS) voltage corresponds to the analog voltage necessary to attain the desired gray scale value.

For example, in a 4-bit PWM scheme, the frame time (time in which a gray scale value is written to every pixel) is divided into 15 time intervals. During each interval, a signal (high, e.g., 5 V or low, e.g., 0 V) is asserted on the pixel storage electrode 106. There are, therefore, 16 (0–15) different gray scale values possible, depending on the number of "high" pulses asserted during the frame time. The assertion of 0 high pulses corresponds to a gray scale value of 0 (RMS 0 V), whereas the assertion of 15 high pulses corresponds to a gray scale value of 15 (RMS 5 V). Intermediate numbers of high pulses correspond to intermediate gray scale levels.

FIG. 2 shows a series of pulses corresponding to the 4-bit gray scale value (1010), where the most significant bit is the far left bit. In this example of binary-weighted pulse-width modulation, the pulses are grouped to correspond to the bits of the binary gray scale value. Specifically, the first group B3 includes 8 intervals ($2^3$), and corresponds to the most significant bit of the value (1010). Similarly, group B2 includes 4 intervals ($2^2$) corresponding to the next most significant bit, group B1 includes 2 intervals ($2^1$) corresponding to the next most significant bit, and group B0 includes 1 interval ($2^0$) corresponding to the least significant bit. This grouping reduces the number of pulses required from 15 to 4, one for each bit of the binary gray scale value, with the width of each pulse corresponding to the significance of its associated bit. Thus, for the value (1010), the first pulse B3 (8 intervals wide) is high, the second pulse B2 (4 intervals wide) is low), the third pulse B1 (2 intervals wide) is high, and the last pulse B0 (1 interval wide) is low. This series of pulses results in an RMS voltage that is approximately $\sqrt{2/3}$ (10 of 15 intervals) of the full value (5 V), or approximately 4.1 V.

FIG. 3 shows 3 pixel cells 100(*a*–*c*) arranged adjacent one another, as in a typical flat panel display. Problems arise in such displays, because differing signals on adjacent pixel cells can cause visible artifacts in a display image. For example, electrical field lines 302 indicate that logical high signals are being asserted on each of pixel electrodes 106(*a* and *c*). The absence of an electrical field across pixel cell 100(*b*) indicates that a logical low signal is being asserted on pixel electrode 106B. Note that in addition to the electrical fields 302 across liquid crystal layers 102(*a* and *c*), transverse fields 304 exist between pixel electrodes 106(*a* and *c*), carrying a logical high signal, and pixel electrode 106(*b*), carrying a logical low signal. Transverse fields 304 affect the polarization rotation of the light passing through liquid crystal layers 102(*a*–*c*), and therefore, potentially introduce visible artifacts.

Whether, and to what extent, visible artifacts are produced between adjacent pixel cells depends on the time period that logically opposite signals (i.e., high and low) are asserted on adjacent pixel electrodes. Adjacent pixel cells carrying opposite signals are said to be out of phase. The percentage of the total frame time that adjacent pixel cells are out of phase is referred to herein as the phase difference between the adjacent cells. Visible artifacts are most noticeable when adjacent pixel cells are written with gray values that are close in intensity, but have a large phase difference.

FIG. 4 is a table showing the bit values and phase differences between selected gray scale values in an eight-bit, binary-weighted, pulse-width modulation scheme. Note that gray values 127 and 128, while having an intensity difference of only one level, have a phase difference of 100%, and thus result in a visible artifact when written to adjacent pixel cells. Similarly, gray values 63 and 64 (as well as gray values 191 and 192) have a phase difference of 127/255, which also causes unacceptable image artifacts.

What is needed is a system and method for reducing the maximum possible phase difference between gray scale values asserted on adjacent pixel electrodes.

SUMMARY

A novel system and method for reducing the maximum possible phase difference between data asserted on adjacent pixel electrodes is described. The system and method employ compound data words, which comprise a first group of bits that are each asserted on a display pixel for a coequal time period, and a second group of bits that are asserted on the display pixel for a time period dependent on their significance. The maximum phase difference between adjacent gray scale values (e.g., gray scale value 79 and gray scale value 80) is thereby limited to one of the bits of the first group and all of the bits of the second group being out of phase.

In one embodiment of the invention, a display driver circuit includes an output controller configured to provide display control signals which cause each bit of the first group of data bits to be asserted on a display pixel for a coequal time period. The control signals also cause each bit of the second group of data bits to be asserted on the pixel for a time period that depends on an associated significance of each bit. Thus, each bit of the first group is asserted for a time period equal to the time period that the other bits of the first group are asserted, and each bit of the second group is asserted for a time period different than the other bits of the second group. In a particular embodiment, the length of each coequal time period is twice as long as the time period associated with the most significant bit of the second group of data bits.

Optionally, the display driver circuit includes a compound data generator, configured to provide compound data words at an output. In a particular embodiment, the compound data generator includes an input terminal for receiving a data word of a first type (e.g., binary-weighted), and the compound data words are generated responsive to receiving the data word of the first type. The compound data generator may comprise, for example, a look-up-table, an arithmetic logic unit which operates on the data word of the first type to generate the compound data word, or a memory device which retrieves a compound data word from a storage location indicated by the data word of the first type.

In a particular embodiment, the compound data generator is configured to convert a first set of the (X) most significant bits of a binary-weighted data word into $(2^X-1)$ equally-weighted bits of the compound data word, thus preserving the gray scale resolution of the binary-weighted data. In an alternate embodiment, the binary-weighted data words are capable of defining a first number of possible gray scale values, the compound data words are capable of defining a second number of possible values less than the first number of possible values, and the binary-weighted data words are mapped over to the compound data words, sacrificing some gray scale resolution.

A disclosed method for asserting a compound data word on a display pixel comprises the steps of asserting each bit of a first group of bits of the compound data word on the display pixel for a coequal time period, and asserting each bit of a second group of bits of the compound data word on the display pixel for a period of time depending on an associated significance of each bit. In a particular method, each bit of the first group is asserted on the display pixel for a time period twice the duration of the time period of the most significant bit of the second group of data bits. Optionally, the method further includes the step of generating the compound data word. In a particular method, the step of generating the compound data word comprises the steps of receiving a data word of a first type, and generating the compound data word from the data word of the first type. In more particular methods, the step of generating the compound data word from the data word of the first type comprises performing a mathematical operation on the data word of the first type, or retrieving the compound data word from a look-up-table or a memory device.

BRIEF DESCRIPTION OF THE DRAWINGS

The present invention is described with reference to the following drawings, wherein like reference numbers denote substantially similar elements:

FIG. 4 is a table showing bit values and phase differences between gray scale values in an 8-bit binary-weighted data scheme;

FIG. 6A is a table showing bit values and phase differences between selected gray scale values defined by the compound data word of FIG. 5A;

FIG. 6B is a table showing bit values and phase differences between selected gray scale values defined by the compound data word of FIG. 5B;

FIG. 7 is a table showing bit values and phase differences between selected gray scale values defined by a compound data word having six equally-weighted data bits and four binary-weighted data bits;

FIG. 8 is a table showing the number of available gray levels and the maximum phase difference between adjacent gray levels, for compound data words employing different numbers of equally-weighted data bits and binary-weighted data bits;

FIG. 11A is a block diagram detailing an alternate compound data generator;

FIG. 11B is a block diagram detailing another alternate compound data generator;

DETAILED DESCRIPTION

This patent application is related to the following co-pending patent applications, filed on or about Nov. 14, 1997 and assigned to a common assignee, each of which is incorporated herein by reference in its entirety:

- De-Centered Lens Group For Use In An Off-Axis Projector, Ser. No. 08/970,887, Matthew F. Bone and Donald Griffin. Koch;
- System And Method For Reducing Peak Current And Bandwidth Requirements In A Display Driver Circuit, Ser. No. 08/970,665, Raymond Pinkham, W. Spencer Worley, III, Edwin Lyle Hudson, and John Gray Campbell;
- System And Method For Using Forced States To Improve Gray Scale Performance Of A Display, Ser. No. 08/970,878, William Spencer Worley, III and Raymond Pinkham;
- System And Method For Data Planarization, Ser. No. 08/970,307, William Weatherford, W. Spencer Worley, III, and Wing Chow; and
- Internal Row Sequencer For Reducing Bandwidth And Peak Current Requirements In A Display Driver Circuit, Ser. No. 08/970,443, Raymond Pinkham, W. Spencer Worley, III, Edwin Lyle Hudson, and John Gray Campbell.

This patent application is also related to co-pending patent application Ser. No. 08/901,059, entitled Replacing Defective Circuit Elements By Column And Row Shifting In A Flat Panel Display, by Raymond Pinkham, filed Jul. 25, 1997, assigned to a common assignee, and is incorporated herein by reference in its entirety.

The present invention overcomes the problems associated with the prior art, by using compound data words to minimize the phase difference of the data asserted on adjacent pixels of a flat panel display. Specifically, the present invention describes a system and method for driving a display with compound data words. A compound data word is a data word formed by combining two groups of bits having a different weighting scheme. In a particular example, a compound data word includes a group of equally-weighted bits and a group of binary-weighted bits. In the following description, numerous specific details are set forth (e.g., the number and types of bits combined to form compound data words) in order to provide a thorough understanding of the invention. Those skilled in the art will recognize, however, that the invention may be practiced apart from these specific details. In other instances, details of well known display driver circuits and methods have been omitted, so as not to unnecessarily obscure the present invention.

Figure 5A:
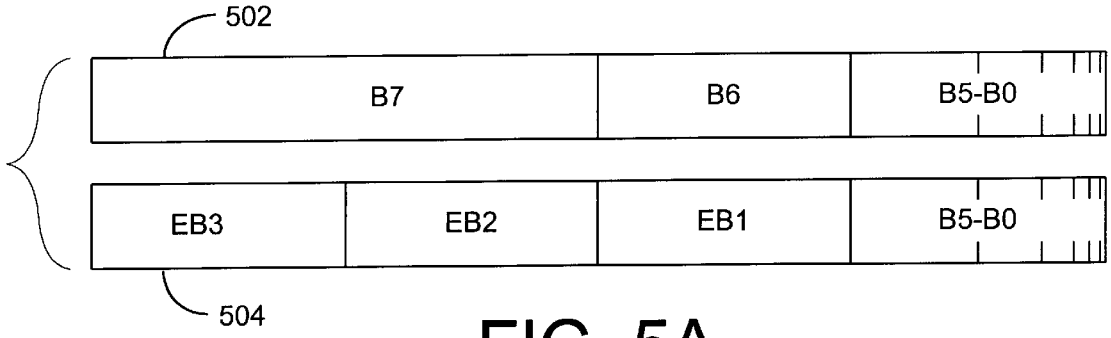
FIG. 5A is a block diagram showing the conversion of the two most significant bits of a binary-weighted data word into three equally-weighted bits of a compound data word.

FIG. 5A shows a bit-block representation of a data word 502 of a first type, in this case binary-weighted, and a compound data word 504. The length of each block represents the significance of the associated bit, and thus the amount of time the bit is to be asserted on a pixel electrode. Data word 502 has 8 bits, B7–B0, each bit having a significance of one-half the next most significant bit (binary-weighted). For example, in data word 502, block B7 is twice as long as block B6.

Compound data word 504 includes a first group of equally-weighted (equal significance) data bits, EB3–EB1, and a second group of binary-weighted data bits B5–B0. In the special case where three equally-weighted data bits are formed from bits B6 and B7 of binary-weighted data word 502, the significance of bits EB3–EB1 is the same as the significance of bit B6, and thus bit B6 may properly be considered a member of either the first group of equally-weighted data bits or the second group of binary-weighted data bits. Those skilled in the art will recognize, however, that the invention may be practiced without this relationship between the first group of equally-weighted data bits and the second group of binary-weighted data bits.

Figure 5B:
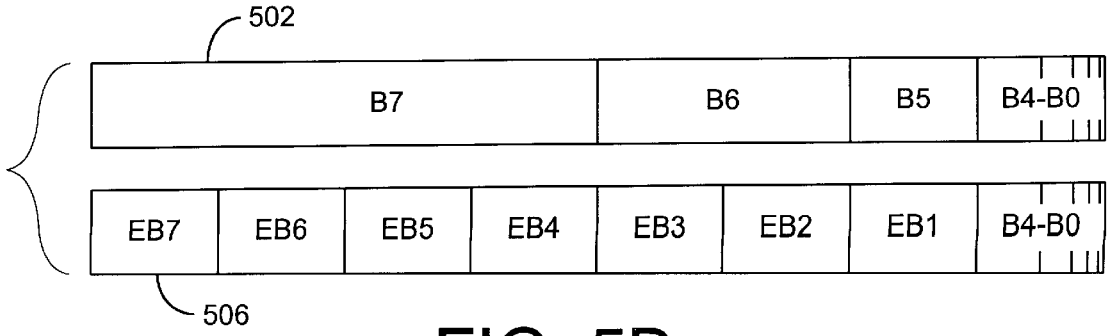
FIG. 5B is a block diagram showing the conversion of the three most significant bits of a binary-weighted data word into seven equally-weighted bits of a compound data word.

FIG. 5B shows a compound data word 506 that results from converting bits B7 and B6 of binary-weighted data word 502 into a group of equally-weighted bits EB7–EB1. Because the significance of bit EB1 is twice the significance of bit B4, bit EB1–B5 may also be considered a member of the second group of binary-weighted data bits.

FIG. 6A is a table showing bit values and phase differences between selected gray scale values defined by compound data word 504 of FIG. 5A. A maximum phase difference of 127/255 occurs between the gray scale values 127–128 and between the gray scale values 191–192. Thus, the maximum phase difference between adjacent gray scale values is approximately one-half that of the binary-weighted data word values shown in FIG. 4.

FIG. 6B is a table showing bit values and phase differences between selected gray scale values defined by compound data word 506 of FIG. 5B. A maximum phase difference of 63/255 occurs between the gray scale values 31–32, 63–64, 95–96, 127–128, 159–160, 191–192, and between the gray scale values 223–224. Thus, the maximum phase difference between adjacent gray scale values is approximately one-fourth that of the binary-weighted data word values shown in FIG. 4.

The reduction in the maximum phase difference between adjacent gray scale values comes at the expense of an increase in the number of bits that must be written to a pixel cell during one frame time. In particular, in order that a compound data word be capable of defining as many gray scale values as the binary-weighted data word from which it was formed, the (X) most significant bits of the binary-weighted data word must be converted into $(2^X-1)$ equally-weighted bits of the compound data word. For example, recall that 2 bits (B7 and B6) of binary-weighted data word 502 were converted into 3 equally-weighted bits (EB3, EB2 and EB1) of compound data word 504 (FIG. 5A). Similarly, 3 bits (B7, B6 and B5) of binary-weighted data word 502 were converted into 7 equally-weighted bits (EB7–EB1) of compound data word 506 (FIG. 5B).

As more bits of the binary-weighted data word are converted to equally-weighted bits, the maximum phase difference between adjacent gray scale values continues to decrease. The increased number of bits, however, increases the display interface bandwidth requirement. In some systems, the interface bandwidth prevents the use of enough equally-weighted bits to reduce the maximum phase difference between adjacent gray scale values to an acceptable level.

The maximum phase difference between adjacent gray scale values can, however, be reduced without adding a prohibitive number of equally-weighted bits, by reducing the gray scale resolution (number of values defined) of the compound data word. For example, an 8-bit binary-weighted data word is capable of defining 256 gray scale values. In general, (n) binary-weighted data bits are capable of defining $2^n$ gray scale values. In contrast, (m) equally-weighted data bits are capable of defining (m+1) gray scale values. Thus, a compound data word comprising a first group of (m) equally-weighted data bits and a second group of (n) binary-weighted data bits is capable of defining $(m+1)(2^n)$ gray scale values. Accordingly, the number (m) of equally-weighted data bits and the number (n) of binary-weighted data bits can be selected to define an adequate number of gray scale values. Then, data words of a first type, for example binary-weighted, can be mapped over to the compound data words having a similar value. If the compound data words are only capable of defining a number of gray scale values less than the number of values defined by the binary-weighted data words, then more than one binary-weighted data word will map over to some of the compound data words.

FIG. 7 is a table showing bit values and phase differences between selected gray scale values defined by a compound data word having six equally-weighted data bits (B9–B4) and four binary-weighted data bits (B3–B0). A maximum phase difference of 31/111 occurs between gray scale values 15–16, 31–32, 47–48, 63–64, 79–80, and 95–96. This maximum phase difference is comparable to the maximum phase difference (63/255, FIG. 6B) of compound data word 506, but is achieved with 2 fewer bits. However, as shown in FIG. 7, the 10-bit compound data word (B9–B0) is only capable of defining 112 different gray scale values.

FIG. 8 is a table 800 showing the number of available gray levels and the maximum phase difference between adjacent gray levels, for compound data words employing various numbers of equally-weighted data bits and binary-weighted data bits. As indicated above, a compound data word having (m) equally-weighted bits and (n) binary-weighted bits is capable of defining $(m+1)(2^n)$ gray scale values. The maximum phase difference between adjacent gray scale values is calculated by dividing the sum of the number of time intervals in one equally-weighted bit and all binary-weighted bits by the total number of time intervals in the frame time. The simplified result is as follows:

$$\frac{2^{m+1}-1}{2^m(n+1)-1}$$

This calculation assumes that as gray scale values are increased, the equally-weighted bits of the compound data word are uniformly incremented, such that no more than one equally-weighted data bit can be out of phase between adjacent gray scale levels. For example, note that for gray scale value 48 of FIG. 7, bits B6–B4 are high and bits B9–B7 are low. Because bits B9–B4 are equally-weighted, gray scale value 48 could also be written with bits B9–B7 being high and bits B6–B4 being low. This alternative representation would, however, have five of the six equally-weighted bits of gray scale value 48 out of phase with respect to gray scale value 47.

Certain relationships are apparent from table 800. First, for a given number of total bits, the number of possible gray scale values increases as the number of binary-weighted data bits increases. Additionally, as the number of equally-weighted data bits increases, the maximum phase difference between adjacent gray scale values decreases. For a given display, a particular compound data scheme (i.e., particular number of equally-weighted bits (m) and binary-weighted data bits (n)) is selected to provide the required number of gray scale levels, maintain an acceptable maximum phase difference, and operate within the system's interface bandwidth. For example, assume that in a particular display visible artifacts appear when the phase difference between adjacent gray scale values exceeds 35%, and that the system must be capable of generating 80 different gray scale levels. Table 800 indicates that 80 gray levels can be obtained using an 8-bit compound data word with 4 equally-weighted bits and 4 binary-weighted bits (4,4). However, the (4,4) scheme has a maximum phase difference of approximately 39.2%, and is, therefore, unacceptable for the system of this example. On the other hand, by using a 9-bit compound data word having 5 equally-weighted data bits and 4 binary-weighted data bits (5,4), 96 gray levels can be obtained, with an acceptable maximum phase difference of 32.6%.

In a particular embodiment, the frame time is allocated among the bits of the compound data word as follows. First, the time period allocated to each equally-weighted bit is defined to be the time that it takes to write one bit to the entire display. Then, the time period allocated to the most significant bit of the binary-weighted bits is defined to be one-half the time period allocated to each equally-weighted bit. For example, consider a system which requires 25 unit time intervals to write one bit to the entire display. In this system the time allocations to the bits of a (6,4) compound data word are as follows. Each of the six equally-weighted bits is asserted on a pixel electrode for 25 time units. Note that the number of unit times allocated to the equally-weighted bits need not be a power of two (i.e., 2, 4, 8, 16, 32, . . . ). The four binary bits are then asserted for 12.5, 6.25, 3.125, and 1.5625 time units, respectively.

Figure 1:
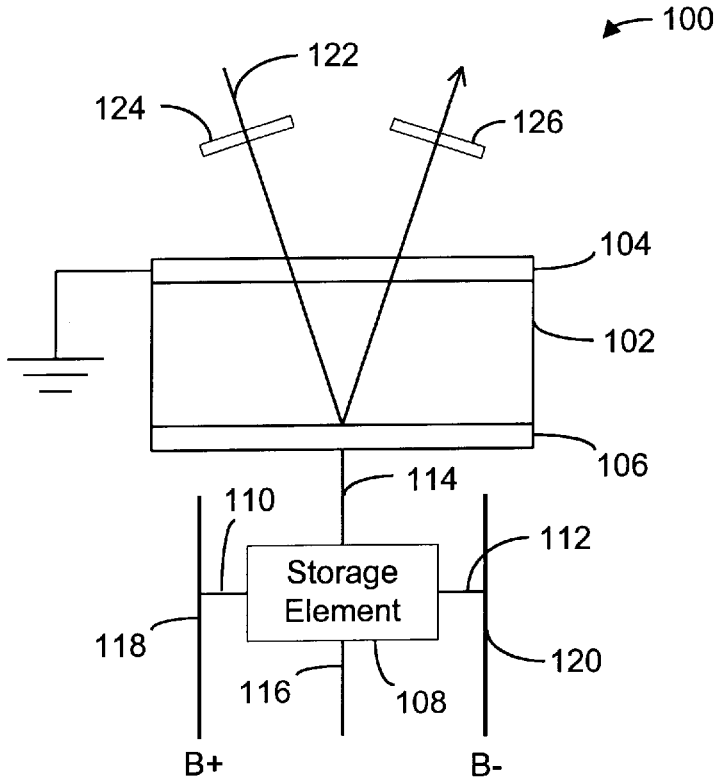
FIG. 1 Prior Art
FIG. 1 shows a single pixel cell of a liquid crystal display.
Figure 2:
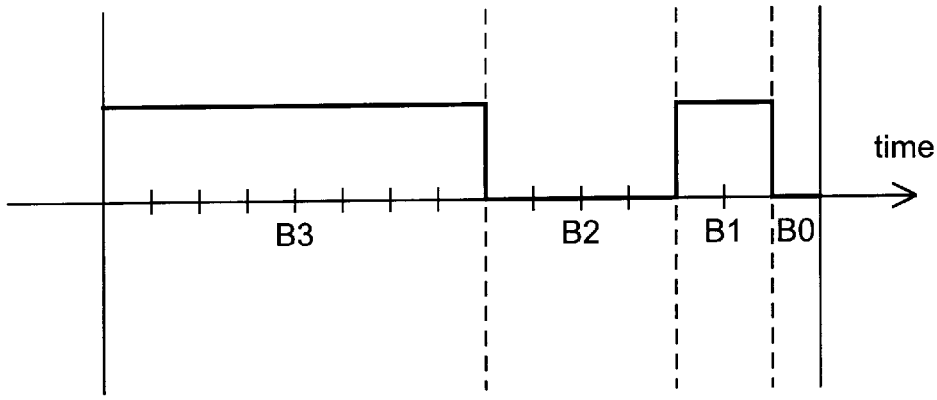
FIG. 2 Prior Art
FIG. 2 shows one frame of 4-bit pulse-width modulation data.
Figure 3:
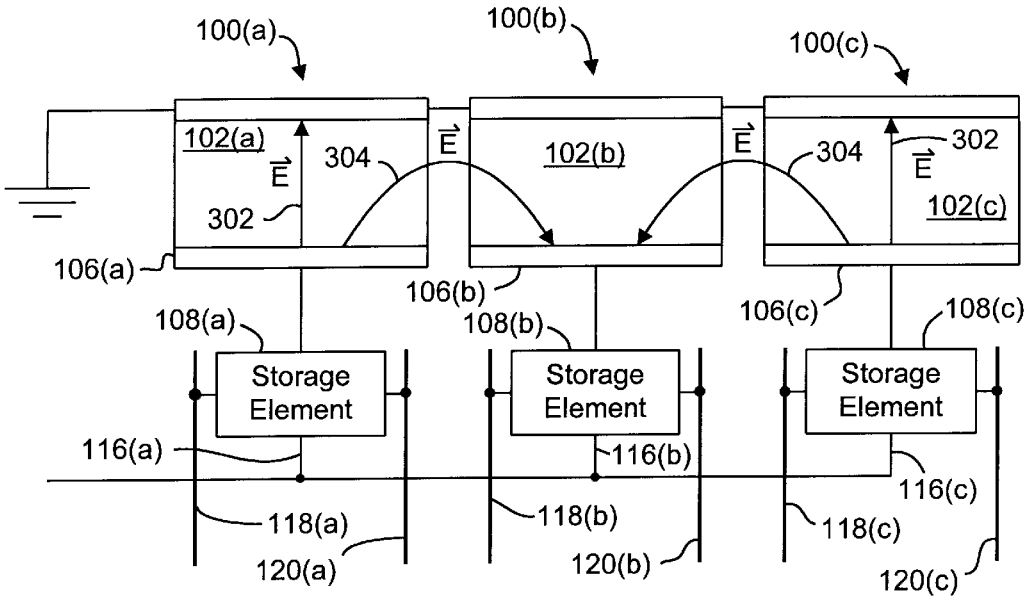
FIG. 3 Prior Art
FIG. 3 shows three adjacent pixel cells of a liquid crystal display.
Figure 9:
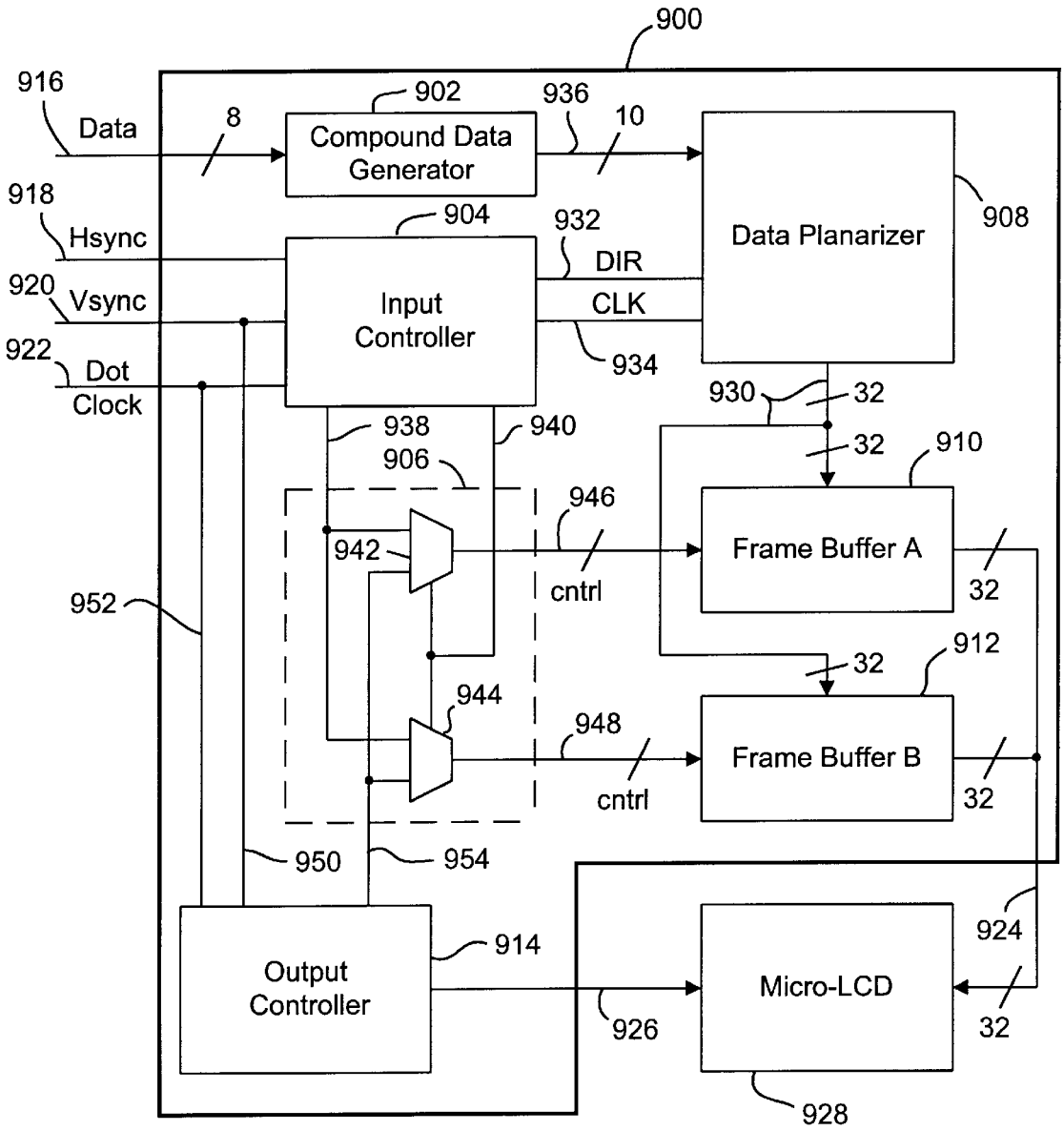
FIG. 9 is a block diagram showing a display driver circuit in accordance with the present invention.

FIG. 9 is a block diagram of a display driver circuit 900, capable of carrying out the above described compound data scheme. Display driver circuit 900 includes a compound data generator 902, an input controller 904, a control selector 906, a data planarizer 908, a frame buffer A 910, a frame buffer B 912, and an output controller 914. Display driver circuit 900 receives 8-bit, binary-weighted data words, via data input bus 916, and receives horizontal synchronization (Hsync), vertical synchronization (Vsync), and pixel dot clock signals via input terminals 918, 920, and 922, respectively. After converting the received binary-weighted data words into planarized compound data words, driver circuit 900 transfers the planarized compound data words, via 32-bit data output bus 924, along with control signals, via LCD control bus 926, to a micro-LCD 928, which includes an array (1024 rows×768 columns) of liquid crystal pixel cells, similar to the pixel cell shown in FIG. 1. Display driver circuit 900 is useful in many types of systems, including, but not limited to, computer displays and video projectors.

Compound data generator 902 receives 8-bit binary-weighted data words via data input bus 916, converts the binary-weighted data words into 10-bit compound data words, and asserts the compound data words on compound data bus 936. In one embodiment, compound data generator 902 is a random access memory (RAM), which retrieves stored compound data words from memory locations indicated by the received binary-weighted data word. Those skilled in the art will understand that other memory devices, for example a read only memory (ROM) or a look-up-table, may be substituted for the RAM. In an alternate embodiment, compound data generator 902 comprises an arithmetic logic unit which performs a mathematical calculation on a received binary-weighted data word to generate a compound data word.

Data planarizer 908 receives the compound data, via compound data bus 936, in 10-bit compound data words, each 10-bits (Pr[0–9]) corresponding to a gray scale value to be written to a particular pixel (r) of micro-LCD 928. Data planarizer 908 accumulates the 10-bit gray scale data for 32 pixels and reformats the data into 32-bit data words, each 32-bit word containing one bit from each of the group of 32 10-bit compound data words. For example, the 32-bit word formed by bits P0[0]–P31 [0] includes the least significant bits of the compound data words for pixels 0–31. This reformatting is necessary because each bit of gray scale data is written to micro-LCD 928 32 pixels at a time.

Input controller 904 uses the Hsync and Vsync signals to coordinate the transfer of compound data from compound data bus 936 into data planarizer 908 and the transfer of planarized data from data planarizer 908, via 32-bit data bus 930 into frame buffers A 910 and B 912. Responsive to the Vsync and Hsync signals indicating valid data on data input bus 916, input controller 904 asserts signals on control lines DIR 932 and CLK 934, causing data to be clocked into and out of data planarizer 908. Specifically, input controller 904 clocks 32 10-bit words into data planarizer 908, and then clocks the data out as 10 32-bit words.

Frame buffer A 910 and frame buffer B 912 are each 32-bit wide synchronous graphics random access memories (SGRAMs). Each of frame buffers 910 and 912 receives data, via 32-bit data bus 930, and stores the data in a memory location associated with a particular bit significance and a particular group of pixels of micro-LCD 928. Further, each of frame buffers 910 and 912 are of sufficient capacity to store 10 bits of gray scale data for each pixel in micro-LCD 928 (i.e., one frame worth of display data). For example, because micro-LCD 828 has 786,432 pixels (1024×768), frame buffers 908 and 910 each store 7,864,320 bits (one display screen worth) of data, or 245,760 32-bit words.

The transfer of data from data bus 930 into frame buffers 910 and 912 is also controlled by input controller 904 in cooperation with control selector 906. Input controller 904 asserts frame buffer control signals on input control bus 938 and a frame buffer select signal (SEL) on select line 940. Input control bus 938 includes a write enable line and address lines for indicating the memory location into which data is to be written. Each memory location corresponds to a particular bit of a compound data word intended for a particular group of pixel cells. For example, one particular 32-bit memory location contains the first equally-weighted data bit for each of pixels 0–31.

Control selector 906 includes a first multiplexer 942 and a second multiplexer 944. First multiplexer 942 has two sets of input terminals, the first set being coupled to the lines of input control bus 938. Second multiplexer 944 also has two sets of input terminals, the second set being coupled to the lines of input control bus 938. The output of first multiplexer 942 is asserted on frame buffer A control bus 946, and the output of second multiplexer 944 is asserted on frame buffer B control bus 948.

First multiplexer 942 and second multiplexer 944 are both controlled by the SEL signal being asserted on select line 940 by input controller 904. Responsive to a first (e.g. high) SEL signal being asserted on select line 940, first multiplexer 942 couples input control bus 938 with frame buffer A control bus 946, thus allowing input controller 904 to load data from data bus 930 into frame buffer A 910. The first SEL signal also causes second multiplexer 944 to decouple input control bus 938 from frame buffer B control bus 948, so that no data is loaded into frame buffer B 912 while frame buffer A 910 is being loaded. Responsive to a second (e.g., low) SEL signal being asserted on select line 940, first multiplexer 942 decouples input control bus 938 from frame buffer A control bus 946 and couples input control bus 938 with frame buffer B control bus 948, thus allowing input controller 904 to load data from data bus 930 into frame buffer B 912. Input controller 904 toggles the SEL signal each time a Vsync signal is received, such that one display screen worth of data is written into each frame buffer 910 and 912 in alternating order.

Output controller 914 receives the Vsync signal via line 950, receives the dot clock input signal via line 952, controls the output of data from frame buffer A 910 and frame buffer B 912, and provides display control signals, via LCD control bus 926, to micro-LCD 928. Output controller 914 controls the output of data from frame buffer A 910 and frame buffer B 912 by asserting control signals on an output control bus 954, which is coupled to the second set of input terminals of first multiplexer 942 and to the first set of input terminals of second multiplexer 944. Thus, when the second SEL signal is asserted on select line 940 by input controller 904, first multiplexer 942 decouples input control bus 938 from and couples output control bus 954 to frame buffer A control bus 946, thus allowing output controller 914 to cause frame buffer A 910 to assert data onto data bus 924. On the other hand, when the first SEL signal is asserted on select line 940, second multiplexer 944 decouples input control bus 938 from and couples output control bus 954 to frame buffer B control bus 948, allowing output controller 914 to cause frame buffer B 912 to assert data onto data bus 924. Thus, while pixel data for one frame is being loaded into frame buffer A 910 by input controller 904, pixel data for the previous frame is being outputted from frame buffer B 912 by output controller 914, and vice versa.

Output controller 914 controls the amount of time that the bits of compound data words are asserted on the pixel electrodes as follows. First, output controller 914 asserts control signals on output control bus 954 causing frame buffer A 910 or frame buffer B 912 (depending on the current state of the SEL signal) to assert the contents of an indicated memory location on data bus 924. Then, output controller 914 asserts control signals on LCD control bus 926, causing micro-LCD 928 to load the bits asserted on data bus 924 onto the appropriate pixel cells. The loaded data remains on the pixel cells until output controller 914 writes the next bit to the pixel cells, a time controlled by output controller 914 to correspond to the significance of the previously loaded bit. Thus, each bit of data remains on the appropriate pixel electrode for a period of time dependent on the significance of the bit.

Figure 10:
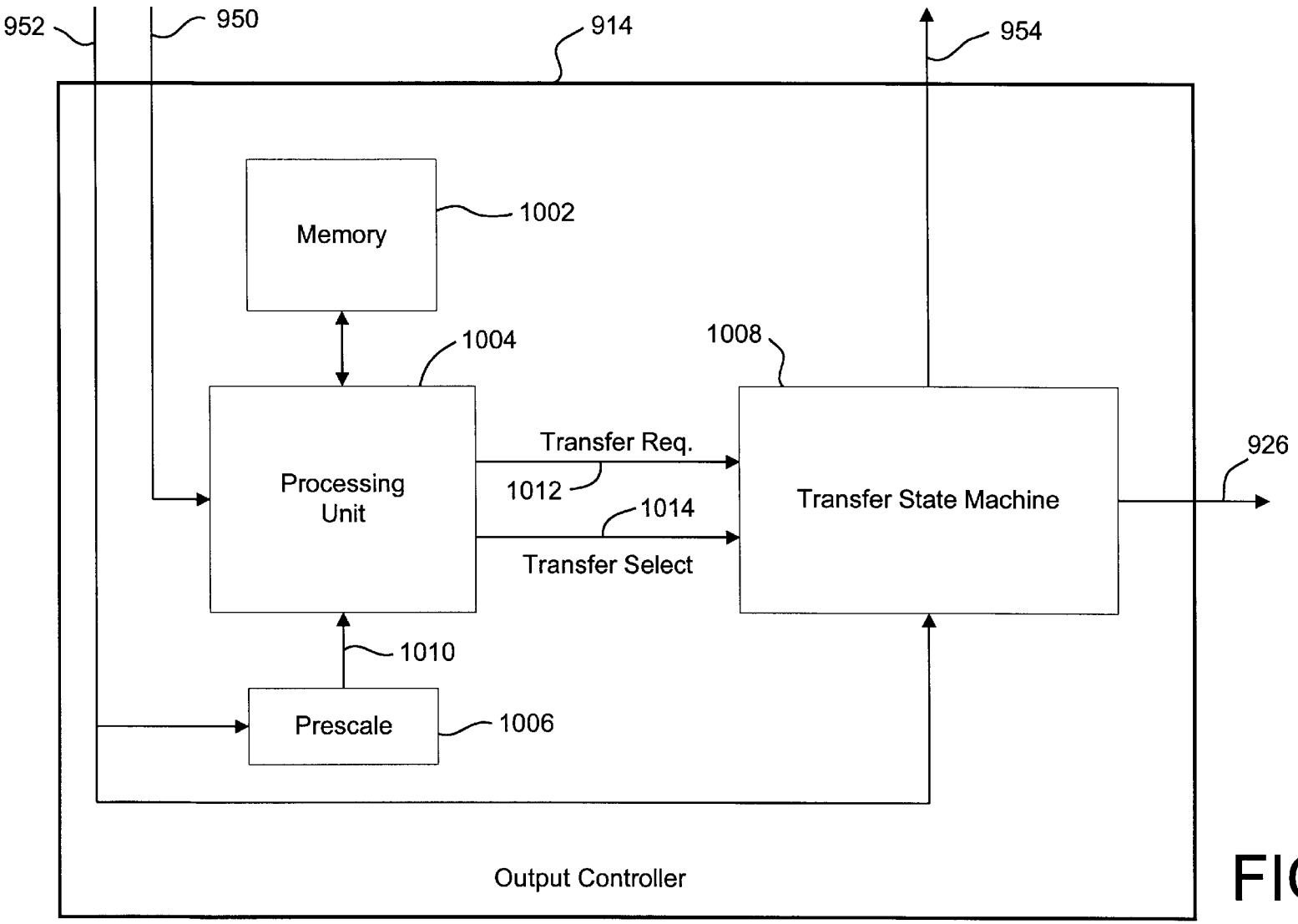
FIG. 10 is a block diagram detailing an output controller shown in FIG. 9.

FIG. 10 is a block diagram showing output controller 914 in greater detail, to include a memory 1002, a processing unit 1004, a prescale 1006, and a transfer state machine 1008. Memory 1002 is a program storage device, which stores data and commands for access and execution by processing unit 1004. Prescale 1006 receives the dot clock signal via line 952, generates a lower frequency timing signal (e.g., ½ the frequency of the dot clock), and communicates the timing signal, via line 1010 to processing unit 1004. The lower frequency timing signal enables processing unit 1004 to employ smaller scale components, for example, smaller counters.

Processing unit 1004 controls transfer state machine 1008 via a transfer request line 1012 and a transfer select bus 1014. Responsive to the signals received from processing unit 1004, transfer state machine 1008 asserts control signals on LCD control bus 926 and output control bus 954, as follows. Transfer select line 1014 is a multi-bit line used to communicate the address of the memory block to be transferred out of frame buffer A 910 or frame buffer B 912. Transfer state machine 1008 uses the block address to initialize the memory address asserted on output control bus 954, and then, responsive to a series of transfer request signals on transfer request line 1012, sequentially increments the memory address while asserting write signals on LCD control bus 926.

Those skilled in the art will recognize that the data need not be written to the display in any particular order, as long as each bit of the compound data word intended for a particular pixel is asserted on that pixel for a portion of the entire frame time corresponding to the significance of the asserted bit. For example, memory 1002 may be programmed such that output controller 914 provides control signals causing bits of a first significance to be written to a first group of pixels. Then, while the bits of the first significance are being asserted on the first group of pixels, output controller 914 may write bits of another significance to another group of pixels. This advantageously eliminates the need to write data to the entire display in the relatively short time period corresponding to the least significant bit. Memory 1002 may be programmed with code for causing data to be written to display 928 in any advantageous order.

In one embodiment, forced state controller 914 is implemented with a programmable logic device part number EPF10K50 BC356-3, manufactured by Altera Corporation of Santa Clara, Calif. The verilog code for programming this device in accordance with the present invention is attached hereto as a microfiche appendix.

FIG. 11A is a block diagram detailing an alternate compound data generator 1100, capable of generating a 9-bit compound data word from an 8-bit binary-weighted data word, by converting the two most significant binary-weighted bits (B7 and B6) into three equally-weighted bits (EB1–EB3). Compound data generator 1100 receives the 8-bit binary-weighted data words via an 8-bit (B7:B0) data input bus 1102, and asserts the compound data words on an output bus including binary-weighted bit lines 1104, first equally-weighted bit (EB1) line 1106, second equally-weighted bit (EB2) line 1108, and third equally-weighted bit (EB3) line 1110. Because the generated compound data word includes bits B5–B0 of the received binary-weighted data word, bit lines B5–B0 of data input bus 1102 are coupled to bit lines B5–B0 of binary-weighted bit lines 1104, respectively.

Compound data generator 1100 further includes a logical OR gate 1112 and a logical AND gate 1114, and generates EB1–EB3 as follows. EB1 is generated by OR gate 1112, which is coupled to logically combine bits B7 and B6 of data input bus 1102, and assert the product (B7 OR B6) on (EB1) line 1106. EB2 is generated by coupling bit B7 of data input bus 1102 to EB2 line 1108 (EB4=B7). EB3 is generated by AND gate 1114, which is coupled to logically combine bits B7 and B6 of data input bus 1102, and assert the product (B7 AND B6) on (EB3) line 1110. Those skilled in the art will understand that other equivalent combinational logic arrays may be substituted for OR gate 1112 and AND gate 1114.

FIG. 11B is a block diagram detailing an alternate compound data generator 1140, capable of generating a 12-bit compound data word from an 8-bit binary-weighted data word, by converting the three most significant binary-weighted bits (B7, B6, and B5) into seven equally-weighted bits (EB1–EB7). Compound data generator 1140 receives the 8-bit binary-weighted data words via an 8-bit (B7:B0) data input bus 1142, and asserts the compound data words on an output bus including binary-weighted bit lines 1144, first equally-weighted bit (EB1) line 1146, second equally-weighted bit (EB2) line 1148, third equally-weighted bit (EB3) line 1150, fourth equally-weighted bit (EB4) line 1152, fifth equally-weighted bit (EB5) line 1154, sixth equally-weighted bit (EB6) line 1156, and seventh equally-weighted bit (EB7) line 1156. Because the generated compound data word includes bits B4–B0 of the received binary-weighted data word, bit lines B4–B0 of data input bus 1142 are coupled to bit lines B4–B0 of binary-weighted bit lines 1144, respectively.

Compound data generator 1140 further includes a first OR gate 1160, a second OR gate 1162, a third OR gate 1164, a fourth OR gate 1166, a first AND gate 1168, a second AND gate 1170, a third AND gate 1172, and a fourth AND gate 1174, and generates equally-weighted bits EB1–EB7 as follows. EB1 is generated by first OR gate 1160, which is coupled to logically combine bits B7, B6, and B5, and assert the product (B7 OR B6 OR B5) on EB1 lines 1146. EB2 is generated by second OR gate 1162, which is coupled to logically combine bits B7 and B6, and assert the product (B7 OR B6) on EB2 line 1148. EB3 is generated by first AND gate 1168, which is coupled to logically combine bits B5 and B6, and third OR gate 1164, which is coupled to logically combine the output of first AND gate 1168 with bit B7, and assert the product ([B6 AND B5] OR B7) on EB3 line 1150. EB4 is generated by coupling bit line B7 of data input bus 1142 (EB4=B7) to EB4 line 1152. EB5 is generated by fourth OR gate 1166, which is coupled to logically combine bits B5 and B6, and second AND gate 1170, which is coupled to logically combine the output of fourth OR gate 1166 with bit B7, and assert the product ([B6 OR B5] AND B7) on EB5 line 1154. EB6 is generated by third AND gate 1172, which is coupled to logically combine bits B7 and B6, and assert the product (B7 AND B6) on EB6 line 1156. EB7 is generated by fourth AND gate 1174, which is coupled to logically combine B7, B6, and B5, and assert the product (B7 AND B6 AND B5) on EB7 line 1158.

Those skilled in the art will understand that any equivalent logic circuit may be substituted for the above described logic gates of compound data generator 1140. Those skilled in the art will also understand that display driver circuit 900 would require routine modifications (e.g., a planarizer capable of planarizing 9-bit or 12-bit compound data words) in order to employ alternate compound data generator 1100 or alternate compound data generator 1140. Further, in view of this disclosure, those skilled in the art will understand that combinational logic may be used to generate $(2^X-1)$ equally-weighted data bits from any number (X) of binary-weighted data bits.

Figure 12:
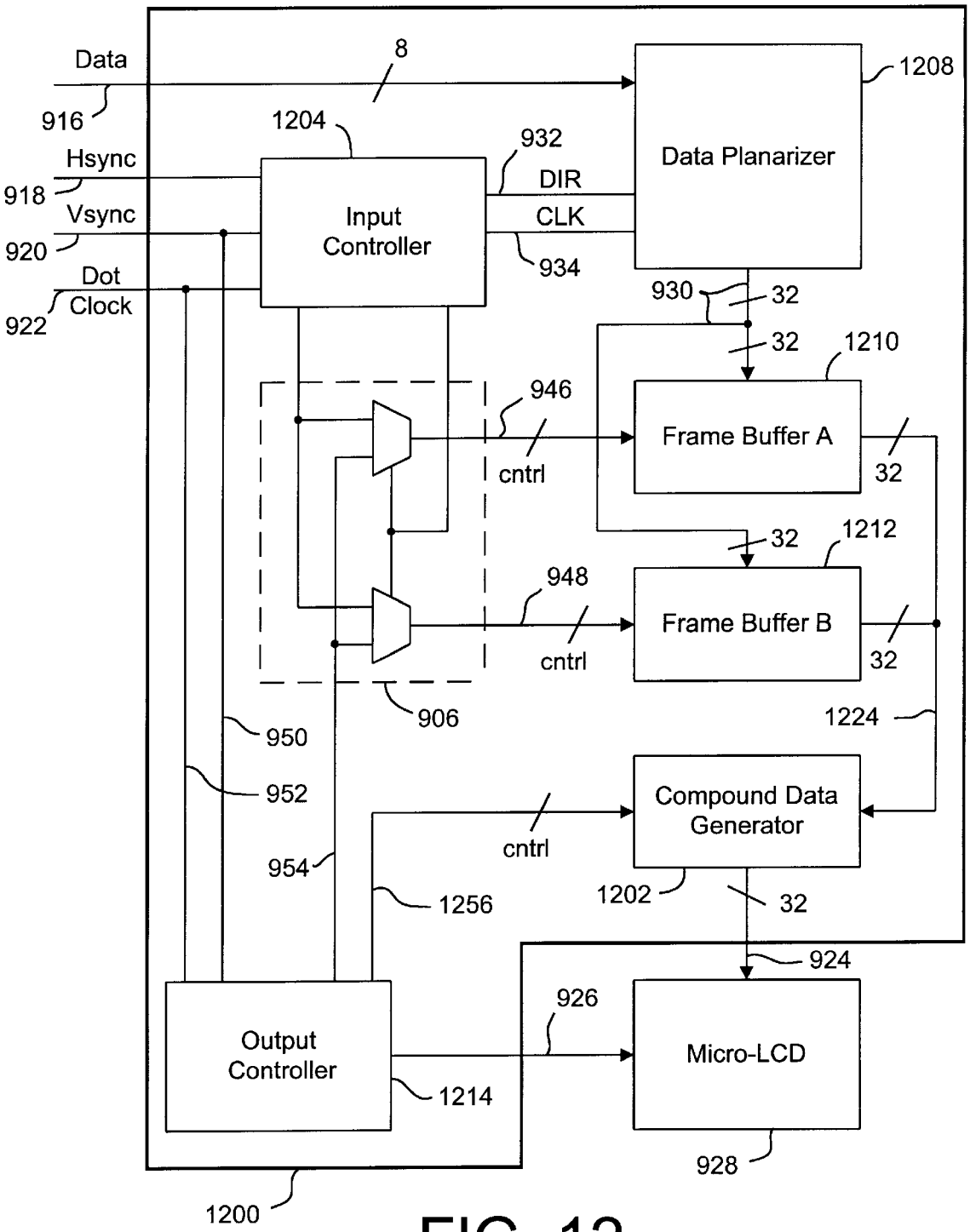
FIG. 12 is a block diagram showing an alternate display driver circuit in accordance with the present invention.

FIG. 12 is a block diagram showing an alternate display driver circuit 1200, in accordance with the present invention. Display driver circuit 1200 includes a compound data generator 1202, an input controller 1204, a control selector 906, a data planarizer 1208, a frame buffer A 1210, a frame buffer B 1212, and an output controller 1214. Display driver circuit 1200 receives 8-bit, binary-weighted data words, via data input bus 916, and receives horizontal synchronization (Hsync), vertical synchronization (Vsync), and pixel dot clock signals via input terminals 918, 920, and 922, respectively. After converting the received binary-weighted data words into planarized compound data words, driver circuit 1200 transfers the planarized compound data words, via 32-bit data output bus 924, along with control signals, via LCD control bus 926, to micro-LCD 928.

Display driver circuit 1200 differs from display driver circuit 900 in that compound data is generated from planarized binary-weighted data. In other words, compound data generator 1202 is disposed downstream (data stream) from data planarizer 1208 in display driver circuit 1200, whereas compound data generator 902 is disposed upstream from data planarizer 908 in display driver circuit 900. This change necessitates/allows some modifications to the various components of display driver circuit 1200, with respect to display driver circuit 900, as will be explained below.

Data planarizer 1208 receives binary-weighted data, via data input bus 916, in 8-bit data words, each 8-bits (Pr[0–7]) corresponding to a gray scale value to be written to a particular pixel (r) of micro-LCD 928. Data planarizer 1208 accumulates the 8-bit gray scale data for 32 pixels and reformats the data into 32-bit data words, each 32-bit word containing one bit from each of the group of 32 8-bit binary-weighted data words. For example, the 32-bit word formed by bits P0[0]–P31[0] includes the least significant bits of the binary-weighted data words for pixels 0–31. Because it planarizes 8-bit data, data planarizer 1208 need only be 8 bits wide, as opposed to 10-bit wide data planarizer 908, thus allowing a beneficial size reduction of approximately 20%.

Input controller 1204 uses the Hsync and Vsync signals to coordinate the transfer of binary-weighted data from data input bus 916 into data planarizer 1208 and the transfer of planarized data from data planarizer 1208, via 32-bit data bus 930, into frame buffers A 1210 and B 1212. Responsive to the Vsync and Hsync signals indicating valid data on data input bus 916, input controller 1204 asserts signals on control lines DIR 932 and CLK 934, causing data to be clocked into and out of data planarizer 1208. Input controller 1204 is substantially identical to input controller 904, except that input controller 1204 clocks 32 8-bit words into data planarizer 1208, and then clocks the data out as 8 32-bit words. Thus, approximately 5% fewer clock cycles are required to planarize binary-weighted data, as compared to the planarization of compound data.

Frame buffer A 1210 and frame buffer B 1212 are substantially identical to frame buffer A 910 and frame buffer B 912, respectively, except that frame buffer A 1210 and frame buffer B 1212 have a smaller capacity, and are, therefore, less expensive to manufacture. Specifically, each of frame buffers 1210 and 1212 are of sufficient capacity to store 8 bits of gray scale data for each pixel in micro-LCD 928 (i.e., one frame worth of display data). For example, because micro-LCD 828 has 786,432 pixels (1024×768), frame buffers 808 and 810 each store 6,291,456 bits (one display screen worth) of data, or 196,608 32-bit words.

Input controller 1204, in cooperation with control selector 906, also controls he transfer of data asserted on data bus 930 by data planarizer 1208 into frame buffers 1210 and 1212. In this respect, input controller 1204 is substantially identical to input controller 904.

Output controller 1214 controls the output of data from frame buffer A 1210 and frame buffer B 1212, and provides display control signals, via LCD control bus 926, to micro-LCD 928, as described above with respect to output controller 914. Output controller 1214 further provides control signals, via control bus 1256, to compound data generator 1202, which are used to convert binary-weighted data into compound data. The number of bit-lines in control bus 1256 depends on the number of binary-weighted data bits that are to be converted to equally-weighted data bits, as will be described below. Compound data generator 1202 receives 32-bit planarized, binary-weighted data, via data bus 1224, uses the planarized binary-weighted data to generate planarized compound data, and asserts the planarized compound data on compound data output bus 924, all under the control of output controller 1214. Programming output controller 1214 to provide the necessary control signals is well within the abilities of those skilled in the art, particularly in light of the detailed description of compound data generator 1202 provided below.

Figure 13:
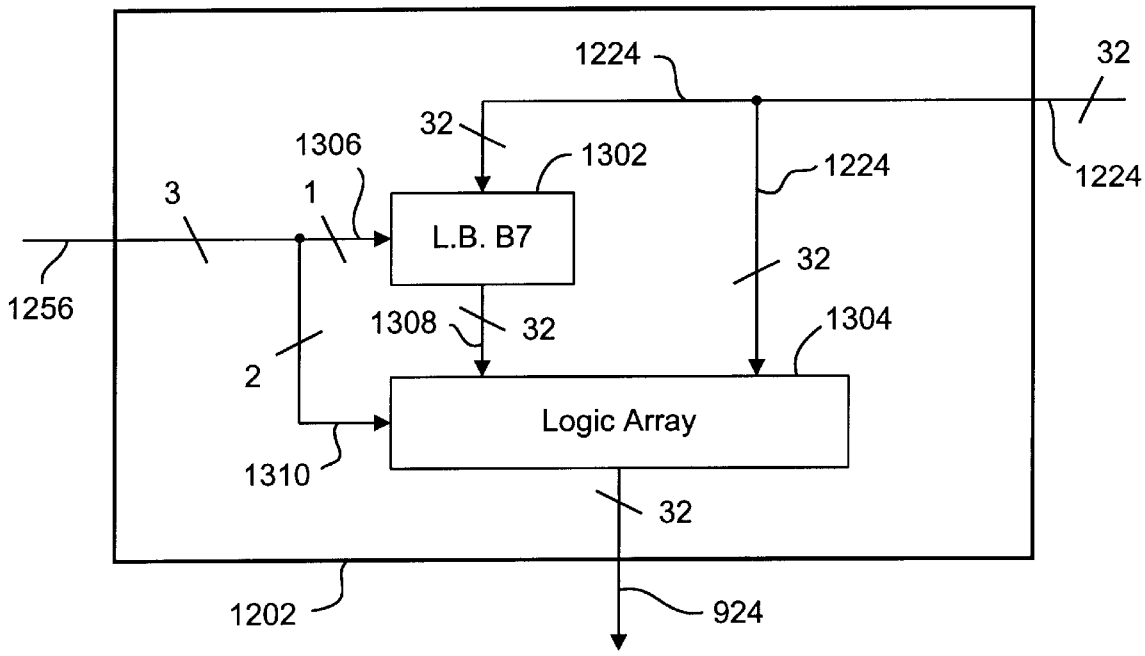
FIG. 13 is a block diagram of a compound data generator shown in FIG. 12.

FIG. 13 is a block diagram showing compound data generator 1202 in greater detail to include a line buffer 1302 and a logic array 1304. This embodiment of compound data generator 1202 generates 3 equally-weighted data bits (EB1, EB2, and EB3) from the 2 most significant bits (B7 and B6) of the binary-weighted data. Responsive to control signals received via 1 line 1306 of 3-bit control bus 1256, line buffer 1302 receives, via data bus 1224, a 32-bit planarized binary-weighted data word made up of the most significant binary-weighted bits (B7) of the data intended for 32 adjacent pixels. Line buffer 1302 stores the data, and asserts the stored 32-bit data word on data lines 1308. Then, responsive to control signals from output controller 1214 (FIG. 12), either frame buffer A 1210 or frame buffer B 1212 asserts a 32-bit data word made up of the next most significant binary-weighted bits (B6), intended for the same 32 adjacent pixels, on data bus 1224. Finally, responsive to control signals received via 2 lines 1310 of control bus 1256, logic array 1304 logically combines the binary-weighted bits (B7 and B6) to generate one of the equally-weighted bits (EB1–EB3), and asserts the equally-weighted bit on data output bus 924.

Logic array 1304 also asserts the less significant binary-weighted data bits (B5–B0) on data output bus 924. In particular, responsive to control signals received from output controller 1214, via 2 lines 1310 of control bus 1256, logic array 1304 selectively couples data bus 1224 with data output bus 924. Thus, binary-weighted bits asserted on data bus 1224 by frame buffers A 1210 and B 1212 are also asserted on data output bus 924.

Figure 14:
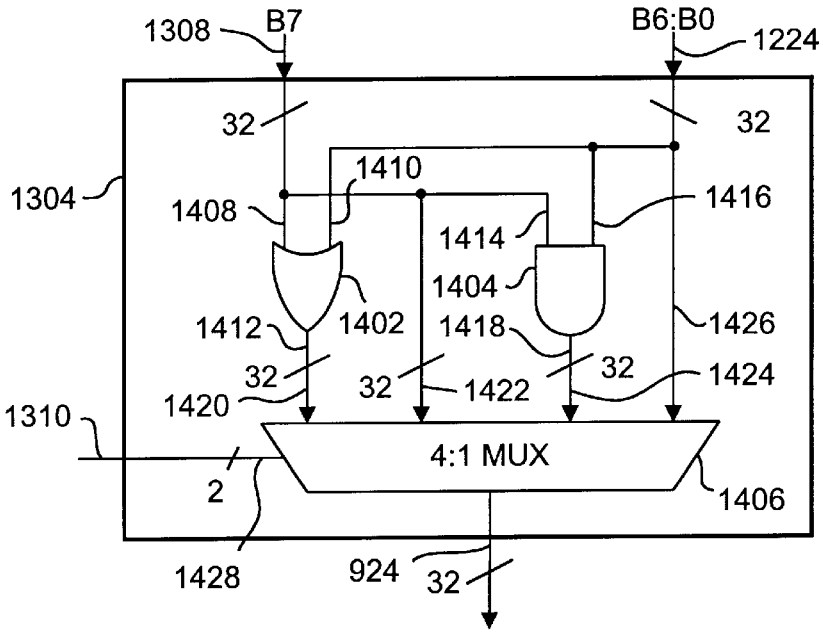
FIG. 14 is a block diagram detailing a logic array shown in FIG. 13.

FIG. 14 is a block diagram showing logic array 1304 in greater detail to include an OR gate 1402, an AND gate 1404, and a 4:1 multiplexer 1406. OR gate 1402 has a first set 1408 of 32 input terminals, a second set 1410 of 32 input terminals, and a set 1412 of 32 output terminals. AND gate 1404 has a first set 1414 of 32 input terminals, a second set 1416 of 32 input terminals, and a set 1418 of 32 output terminals. Multiplexer 1406 has a first set 1420 of 32 input terminals coupled to output terminals 1412 of OR gate 1402, a second set 1422 of 32 input terminals coupled to data lines 1308, a third set 1424 of 32 input terminals coupled to output terminals 1418 of AND gate 1404, a fourth set 1426 of 32 input terminals coupled to data bus 1224, and a set 1428 of 2 control terminals coupled to 2 lines 1310 of control bus 1256.

OR gate 1402 logically combines each input terminal of first set 1408 with a corresponding input terminal of second set 1410, and asserts the logical product on a corresponding output terminal of set 1412. AND gate 1404 logically combines each input terminal of first set 1414 with a corresponding input terminal of second set 1416, and asserts the logical product on a corresponding output terminal of set 1418. Responsive to control signals received on control terminals 1428, multiplexer 1406 selectively couples one of input terminal sets 1420, 1422, 1424, or 1426 with data output bus 924.

Thus configured, logic array 1304 can output each bit of a compound data word. When B7 and B6 are asserted on data lines 1308 and data bus 1224, respectively, multiplexer 1406 outputs equally-weighted bits EB1–EB3 by selectively coupling data output bus 924 with one of input terminal sets 1420, 1422, or 1424, corresponding to the desired logical combination. In particular, first input terminal set 1420 corresponds to EB1 (EB1=B7 OR B6), second input terminal set 1422 corresponds to EB2 (EB2=B7), and third input terminal set 1424 corresponds to EB3 (EB3=B7 AND B6). Multiplexer 1406 outputs binary-weighted bits by selectively coupling input terminal set 1426 with data output bus 924, when one of frame buffers A 1210 or B 1212 is asserting one of binary-weighted bits B5–B0 on data bus 1224.

Figure 15:
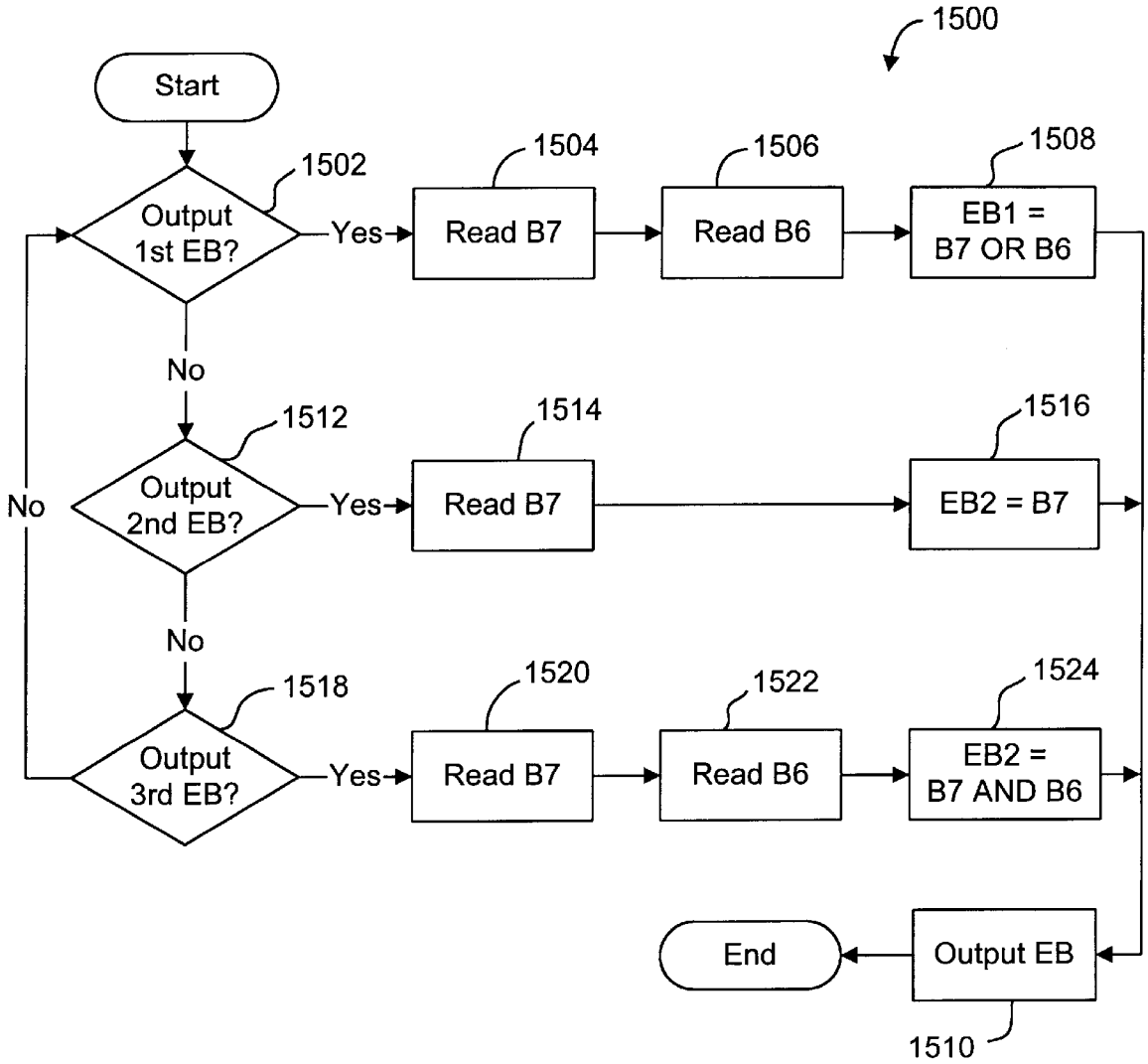
FIG. 15 is a flow chart showing a method for generating 3 equally-weighted data bits from 2 binary-weighted data bits.

FIG. 15 is a flow chart showing a method 1500 for generating 3 equally-weighted data bits (EB1, EB2, and EB3) from 2 binary-weighted data bits (B7 and B6). Method 1500 is described from the perspective of compound data generator 1202, but those skilled in the art will recognize that compound data generator 1202, as well as frame buffers A 1210 and B 1212, act under the control of output controller 1214. For example, in order for compound data generator 1202 to "read" a line of data bits (e.g., B7), output controller 1214 must provide control signals to one of frame buffers A 1210 or B 1212 causing B7 to be asserted on data bus 1224, and must provide control signals to compound data generator 1202 causing line buffer 1302 to load the asserted data.

In a first step 1502, output controller 1214 determines whether the first equally-weighted bit (EB1) is to be generated. If EB1 is to be generated, then in a second step 1504 compound data generator reads B7 into line buffer 1302. Next, in a third step 1506, compound data generator 1202 reads B6 (i.e., frame buffer A 1210 or B 1212 asserts B6 on data bus 1224). Then, in a fourth step 1508, OR gate 1402 logically combines B7 and B6 to generate EB1, and in a fifth step 1510, multiplexer 1406 outputs EB1 by coupling first input terminal set 1420 with data output bus 924, afterwhich method 1500 ends.

If, in first step 1502, output controller 1214 determines that EB1 is not to be generated, then in a sixth step 1512, output controller 1214 determines whether the second equally-weighted bit (EB2) is to be generated. If EB2 is to be generated, then in a seventh step 1514 compound data generator 1202 reads B7 into line buffer 1302. Next, in an eighth step 1516, logic array 1304 sets EB2 equal to B7 (second set of input terminals 1422 coupled to data lines 1308). Method 1500 then proceeds to fifth step 1510, where multiplexer 1406 outputs EB2 by coupling second input terminal set 1422 with data output bus 924, afterwhich method 1500 ends.

If, in sixth step 1512, output controller 1214 determines that EB2 is not to be generated, then in a ninth step 1518, output controller 1214 determines whether the third equally-weighted bit (EB3) is to be generated. If EB3 is to be generated, then in a tenth step 1520 compound data generator reads B7 into line buffer 1302, and in an eleventh step 1522 reads B6. Then, in a twelfth step 1524, AND gate 1416 logically combines B7 and B6 to generate EB3, and method 1500 proceeds to fifth step 1510, where multiplexer 1406 outputs EB3 by coupling third input terminal set 1424 with data output bus 924. If, in ninth step 1518, output controller determines that EB3 is not to be generated, then method 1500 returns to first step 1502.

Figure 16:
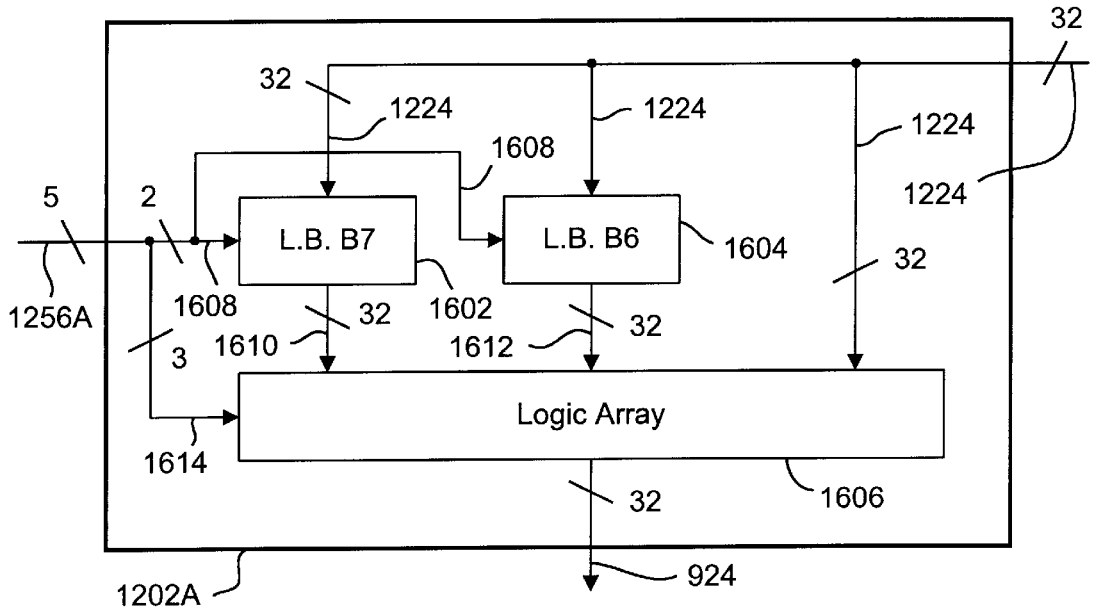
FIG. 16 is a block diagram showing an alternate compound data generator.

FIG. 16 is a block diagram showing an alternate compound data generator 1202A in greater detail to include a first line buffer 1602, a second line buffer 1604, and a logic array 1606. This embodiment of compound data generator 1202A generates 7 equally-weighted data bits (EB1–EB7) from the 3 most significant bits (B7–B5) of the binary-weighted data. Responsive to control signals received via 2 lines 1608 of 5-bit control bus 1256A, first line buffer 1602 and second line buffer 1604 receive, via data bus 1224, 32-bit planarized binary-weighted data words made up of the most significant binary-weighted bits (B7) and the next most significant binary-weighted bits (B6), respectively. Line buffers 1602 and 1604 store the data, and assert the stored 32-bit data words on data lines 1610 and data lines 1612, respectively. Then, responsive to control signals from output controller 1214 (FIG. 12), either frame buffer A 1210 or frame buffer B 1212 asserts a 32-bit data word made up of the next most significant binary-weighted bit (B5) on data bus 1224. Finally, responsive to control signals received via 3 lines 1614 of control bus 1256A, logic array 1606 logically combines the binary-weighted bits (B7–B5) to generate one of the equally-weighted bits (EB1–EB7), and asserts the equally-weighted bit on data output bus 924.

Logic array 1606 also asserts the less significant binary-weighted data bits (B4–B0) on data output bus 924. In particular, responsive to control signals received from output controller 1214, via 3 lines 1614 of control bus 1256A, logic array 1606 selectively couples data bus 1224 with data output bus 924. Thus, binary-weighted bits asserted on data bus 1224 by frame buffers A 1210 and B 1212 are also asserted on data output bus 924.

Figure 17:
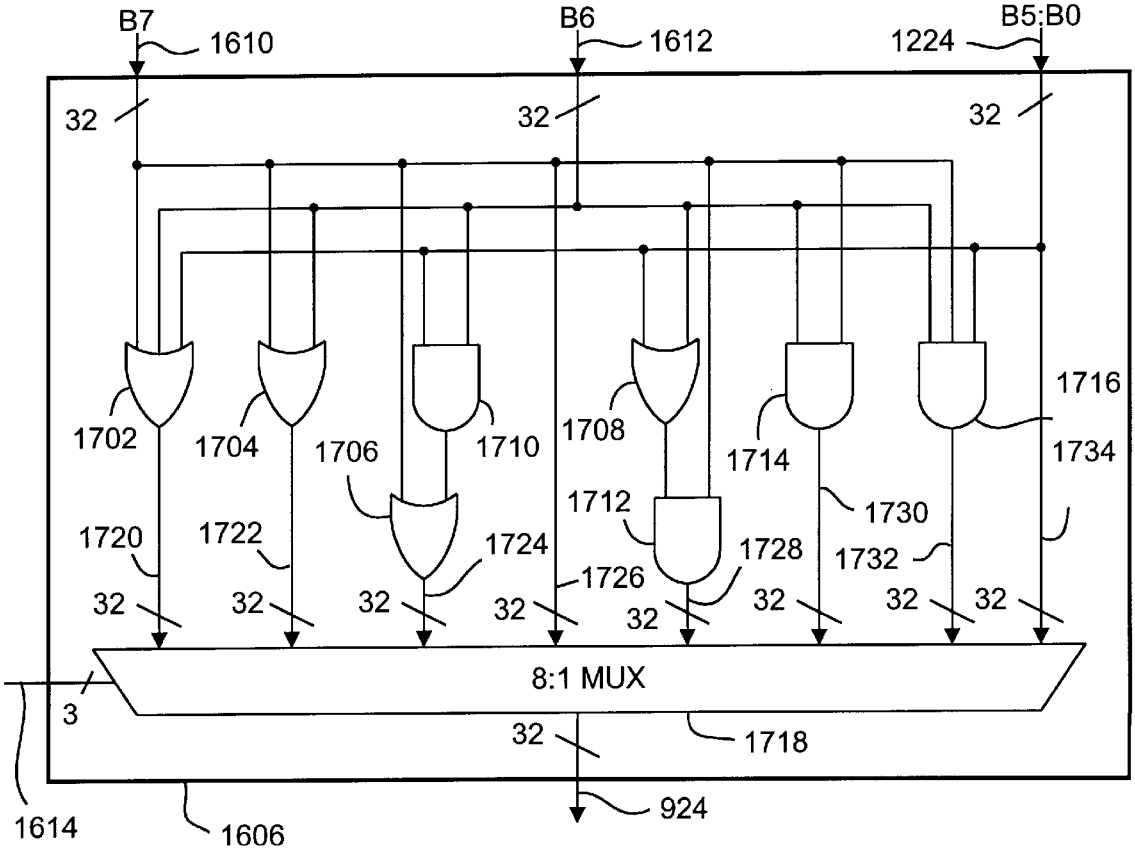
FIG. 17 is a block diagram detailing a logic array shown in FIG. 16.

FIG. 17 is a block diagram showing logic array 1606 in greater detail to include a first OR gate 1702, a second OR gate 1704, a third OR gate 1706, a fourth OR gate 1708, a first AND gate 1710, a second AND gate 1712, a third AND gate 1714, a fourth AND gate 1716, and an 8:1 multiplexer 1718.

Logic array 1606 generates equally-weighted bits EB1–EB7 as follows. EB1 is generated by first OR gate 1702, which is coupled to logically combine bits B7, B6, and B5, and assert the product (B7 OR B6 OR B5) on a first input terminal set 1720 of multiplexer 1718. EB2 is generated by second OR gate 1704, which is coupled to logically combine B7 and B6, and assert the product (B7 OR B6) on a second input terminal set 1722 of multiplexer 1718. EB3 is generated by first AND gate 1710, which is coupled to logically combine bits B5 and B6, and third OR gate 1706, which is coupled to logically combine the output of first AND gate 1710 with bit B7, and assert the product ([B6 AND B5] OR B7) on a third input terminal set 1724 of multiplexer 1718. EB4 is generated by coupling data lines 1610 (EB4=B7) to a fourth input terminal set 1726 of multiplexer 1718. EB5 is generated by fourth OR gate 1708, which is coupled to logically combine bits B5 and B6, and second AND gate 1712, which is coupled to logically combine the output of fourth OR gate 1708 with bit B7, and assert the product ([B6 OR B5] AND B7) on a fifth input terminal set 1728 of multiplexer 1718. EB6 is generated by third AND gate 1714, which is coupled to logically combine B7 and B6, and assert the product (B7 AND B6) on a sixth input terminal set 1730 of multiplexer 1718. EB7 is generated by fourth AND gate 1716, which is coupled to logically combine B7, B6, and B5, and assert the product (B7 AND B6 AND B5) on a seventh input terminal set 1732 of multiplexer 1718. Responsive to control signals received via 3 lines 1614 of control bus 1256A, multiplexer 1718 selectively asserts bits EB1–EB7 on data output bus 924.

Binary-weighted bits (B4–B0) are generated by coupling an eighth input terminal set 1734 of multiplexer 1718 to data bus 1224. Responsive to control signals received via 3 lines 1614 of control bus 1256A, multiplexer 1718 couples eighth input terminal set 1734 to data output bus 924, so that when bits B4–B0 are asserted on data bus 1224 by one of frame buffers A 1210 or B 1212, bits B4–B0 are also asserted on data output bus 924.

Figure 18:
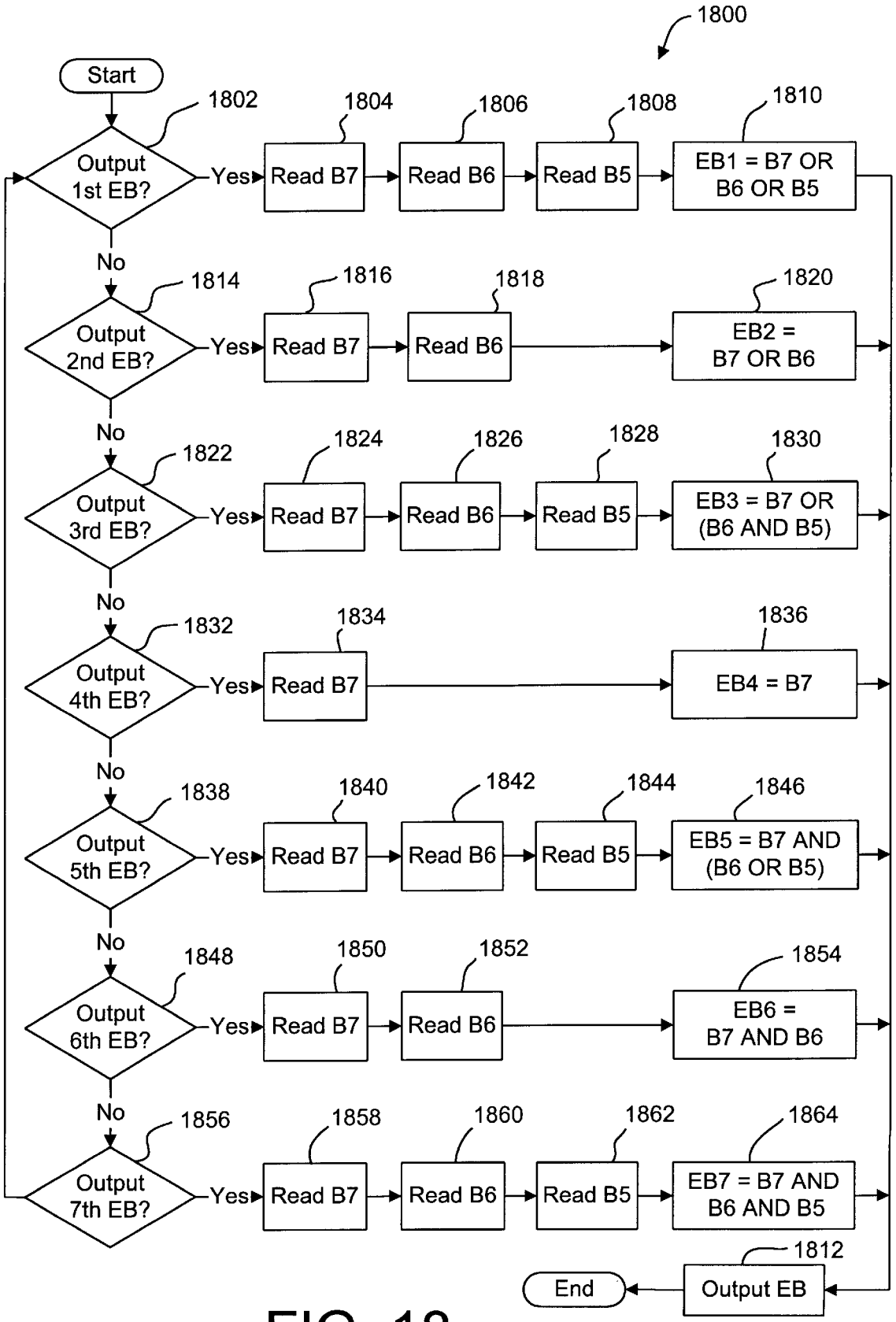
FIG. 18 is a flow chart showing a method for generating 7 equally-weighted data bits from 3 binary-weighted data bits.

FIG. 18 is a flow chart showing a method 1800 for generating 7 equally-weighted data bits (EB1–EB7) from 3 binary-weighted data bits (B7–B5). In a first step 1802, output controller 1214 determines whether the first equally-weighted bit (EB1) is to be generated. If EB1 is to be generated, then in a second step 1804 compound data generator 1202A reads B7 into line buffer 1602, and in a third step 1806 reads B6 into line buffer 1604. Next, in a fourth step 1808, compound data generator 1202A reads B5 (i.e., frame buffer A 1210 or B 1212 asserts B6 on data bus 1224). Then, in a fifth step 1810, OR gate 1702 logically combines B7, B6, and B5 to generate EB1, and in a sixth step 1812, multiplexer 1718 outputs EB1 by coupling first input terminal set 1720 with data output bus 924, afterwhich method 1800 ends.

If, in first step 1802, output controller 1214 determines that EB1 is not to be generated, then in a seventh step 1814, output controller 1214 determines whether the second equally-weighted bit (EB2) is to be generated. If EB2 is to be generated, then in an eighth step 1816 compound data generator 1202A reads B7 into line buffer 1602, and, in a ninth step 1818, reads B6 into line buffer 1604. Next, in a tenth step 1820, OR gate 1704 logically combines B7 and B6 to generate EB2. Method 1800 then proceeds to sixth step 1812, where multiplexer 1718 outputs EB2 by coupling second input terminal set 1722 with data output bus 924, afterwhich method 1800 ends.

If, in seventh step 1814, output controller 1214 determines that EB2 is not to be generated, then in an eleventh step 1822, output controller 1214 determines whether the third equally-weighted bit (EB3) is to be generated. If EB3 is to be generated, then in a twelfth step 1824 compound data generator 1202A reads B7 into line buffer 1602, and in a thirteenth step 1826 reads B6 into line buffer 1604. Next, in a fourteenth step 1828, compound data generator 1202A reads B5. Then, in a fifteenth step 1830, OR gate 1706 and AND gate 1710 logically combine B7, B6, and B5 to generate EB3, and method 1800 proceeds to sixth step 1812, where multiplexer 1718 outputs EB3 by coupling third input terminal set 1724 with data output bus 924, afterwhich method 1800 ends.

If, in eleventh step 1822, output controller 1214 determines that EB3 is not to be generated, then in a sixteenth step 1832, output controller 1214 determines whether the fourth equally-weighted bit (EB4) is to be generated. If EB4 is to be generated, then in a seventeenth step 1834, compound data generator 1202A reads B7 into line buffer 1602, and in an eighteenth step 1836 logic array 1606 sets EB4 equal to B7 (fourth set of input terminals 1726 coupled to data lines 1610). Next, method 1800 proceeds to sixth step 1812, where multiplexer 1718 outputs EB4 by coupling fourth input terminal set 1726 with data output bus 924, afterwhich method 1800 ends.

If in sixteenth step 1832, output controller 1214 determines that EB4 is not to be generated, then in a nineteenth step 1838, output controller 1214 determines whether the fifth equally-weighted bit (EB5) is to be generated. If EB5 is to be generated, then in a twentieth step 1840 compound data generator 1202A reads B7 into line buffer 1602, and in a twenty-first step 1842 reads B6 into line buffer 1604. Next, in a twenty-second step 1844, compound data generator 1202A reads B5. Then, in a twenty-third step 1846, OR gate 1708 and AND gate 1712 logically combine B7, B6, and B5 to generate EB5, and method 1800 proceeds to sixth step 1812, where multiplexer 1718 outputs EB5 by coupling fifth input terminal set 1728 with data output bus 924, afterwhich method 1800 ends.

If, in nineteenth step 1838, output controller 1214 determines that EB5 is not to be generated, then in a twenty-fourth step 1848, output controller 1214 determines whether the sixth equally-weighted bit (EB6) is to be generated. If EB6 is to be generated, then in a twenty-fifth step 1850 compound data generator 1202A reads B7 into line buffer 1602, and, in a twenty-sixth step 1852, reads B6 into line buffer 1604. Next, in a twenty-seventh step 1854, AND gate 1714 logically combines B7 and B6 to generate EB6. Method 1800 then proceeds to sixth step 1812, where multiplexer 1718 outputs EB6 by coupling sixth input terminal set 1730 with data output bus 924, afterwhich method 1800 ends.

If in twenty-fourth step 1848, output controller 1214 determines that EB6 is not to be generated, then in a twenty-eighth step 1856, output controller 1214 determines whether the seventh equally-weighted bit (EB7) is to be generated. If EB7 is to be generated, then in a twenty-ninth step 1858 compound data generator 1202A reads B7 into line buffer 1602, and in a thirtieth step 1860 reads B6 into line buffer 1604. Next, in a thirty-first step 1862, compound data generator 1202A reads B5. Then, in a thirty-second step 1864, AND gate 1716 logically combine B7, B6, and B5 to generate EB7, and method 1800 proceeds to sixth step 1812, where multiplexer 1718 outputs EB7 by coupling seventh input terminal set 1732 with data output bus 924, afterwhich method 1800 ends. If, in twenty-eighth step 1856, output controller determines that EB7 is not to be generated, then method 1800 returns to first step 1802.

Figure 19:
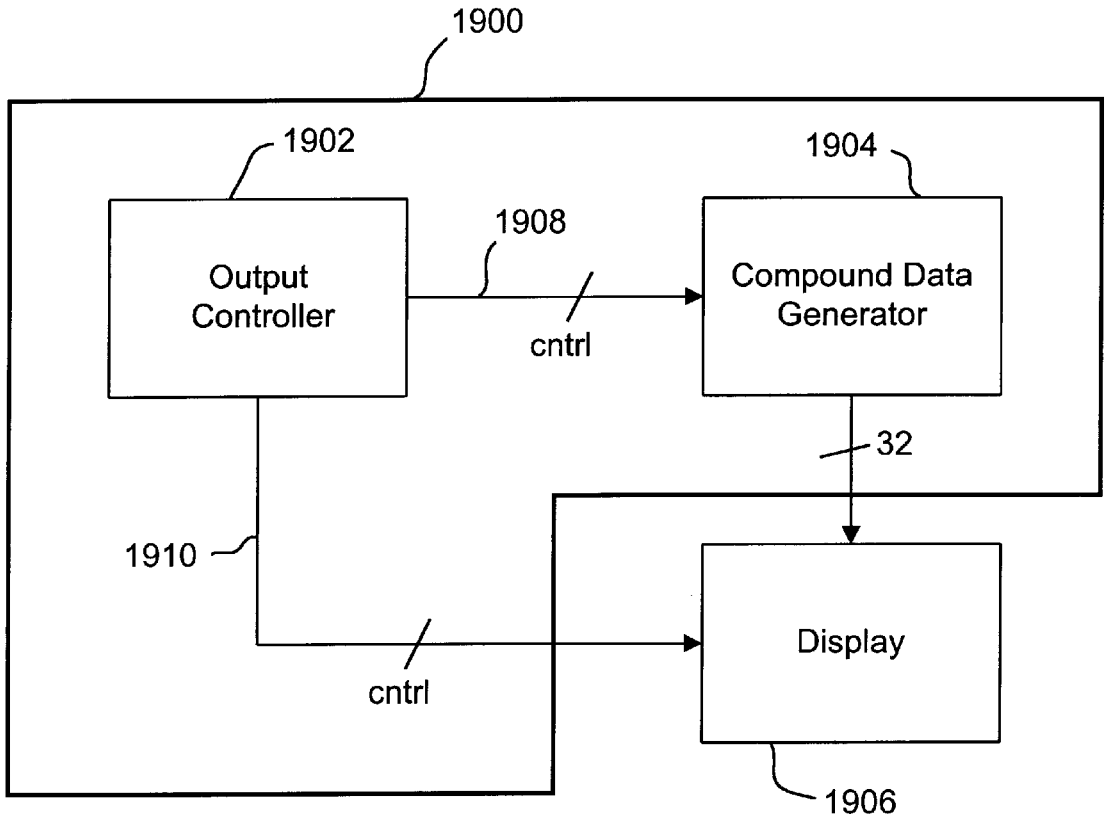
FIG. 19 is a block diagram showing an alternate display driver circuit in accordance with the present invention.

FIG. 19 is a block diagram of an alternate display driver circuit 1900 in accordance with the present invention. Display driver circuit 1900 includes an output controller 1902 and a compound data generator 1904. In contrast to compound data generator 902 of FIG. 9, which converts binary-weighted data words into compound data words, compound data generator 1904 is pre-loaded with the compound data words necessary to generate a desired display. Output controller 1902 provides control signals to compound data generator 1904 and a display 1906, via output control bus 1908 and display control bus 1910, respectively, to coordinate the transfer of data from compound data generator 1904 to display 1906, substantially as described above with respect to output controller 914.

Because there is no need to convert incoming binary-weighted data words into compound data words, display driver circuit 1900 is less complex than display driver circuit 900, and is useful in applications where the image to be displayed is stored in advance, for example a sign which repeatedly displays an advertisement.

The description of particular embodiments of the present invention is now complete. Many of the described features may be substituted, altered or omitted without departing from the scope of the invention. For example, data of other types (i.e., other than binary-weighted) may be converted to compound data. Additionally, a compound data word may be formed from three or more groups of bits. For example, a compound data word may include a first group of binary-weighted bits, a second group of equally-weighted bits, and a third group of equally-weighted bits having a different significance than the second group of equally-weighted bits. Further, the use of compound data is not limited to liquid crystal displays. Rather, compound data may be beneficially used wherever it is desirable to reduce the phase difference between adjacent data values.

We claim:

1. A display driver circuit for writing a compound data word to a pixel of a display, said compound data word comprising a group of equally weighted data bits and a group of binary weighted data bits, said compound data word having a value at least partially defined by said group of equally weighted data bits and said group of binary weighted data bits said display driver circuit comprising:

a compound data generator, configured to receive a binary-weighted data word, to convert at least one bit of said binary weighted data word to said group of equally weighted data bits, to include at least one other bit of said binary weighted data word in said group of binary weighted data bits, and to provide said compound data word at an output; and an output controller configured to provide display control signals at an output; and whereby, responsive to said display control signals said display asserts each bit of said group of equally-weighted data bits on said pixel for a coequal time period, and asserts each bit of said group of binary-weighted data bits on said pixel for a time period dependent on an associated significance of each said binary-weighted bit; such that an output of said pixel corresponds to said value of said compound data word.

2. A display driver circuit for writing a compound data word to a display pixel, said compound data word comprising a first group of data bits and a second group of data bits, said display driver circuit comprising:

a compound data word generator configured to receive a data word of a first type, to convert at least one bit of said data word of said type into said first group of data bits, to include at least one other bit of said data word of said first type in said second group of data bits, and to provide said compound data word at an output; and an output controller configured to provide display control signals, said display control signals causing each bit of said first group of data bits to be asserted on said display pixel for a coequal time period, and causing each bit of said second group of data bits to be asserted on said display pixel for a differing time period dependent on an associated significance of each said bit.

3. A display driver circuit in accordance with claim 2, wherein the length of each of said coequal time periods is a multiple of said time period of the most significant bit of said second group of data bits.

4. A display driver circuit in accordance with claim 3, wherein the length of each of said coequal time periods is twice the length of said time period of the most significant bit of said second group of data bits.

5. A display driver circuit according to claim 2, wherein said compound data generator comprises an arithmetic logic unit for operating on said data word of said first type to generate said compound data word.

6. A display driver circuit according to claim 2, wherein said compound data generator comprises a memory device.

7. A display driver circuit according to claim 2, wherein said compound data generator comprises a look-up-table.

8. A display driver circuit according to claim 2, wherein said data word of said first type is a binary-weighted data word.

9. A display driver circuit according to claim 8, wherein said binary-weighted data word is capable of defining a first number of values and said compound data word is capable of defining a second number of values, said first number of values being greater than said second number of values.

10. A display driver circuit according to claim 9, wherein said value of said compound data word generated by said compound data generator is the one of said second number of values nearest said value of said binary-weighted data word.

11. A display driver circuit according to claim 9, wherein said value (Vc) of said compound data word generated by said compound data generator is defined by the formula Vc=INT(GC/N), where G represents said value of said binary-weighted data word, C represents said second number of possible values of said compound data word, N represents said first number of possible values of said binary-weighted data word, and INT represents the integer function.

12. A display driver circuit for writing a compound data word to a display pixel, said compound data word comprising a first group of data bits and a second group of data bits, said display driver circuit comprising:

a compound data generator configured to provide, at an output, said compound data word; and an output controller configured to provide display control signals, said display control signals causing each bit of said first group of data bits to be asserted on said display pixel for a coequal time period, and causing each bit of said second group of data bits to be asserted on said display pixel for a differing time period dependent on an associated significance of each said bit; and wherein, said compound data generator includes an input terminal for receiving a binary-weighted data word, said compound data word is generated in response to receipt of said binary-weighted data word, and said compound data generator is configured to convert at least one bit of said binary-weighted data word to said first group of bits of said compound data word.

13. A display driver circuit according to claim 12, wherein said compound data generator comprises:

an output terminal; and an OR gate having a first input terminal coupled to receive a first bit of said binary-weighted data word, a second input terminal coupled to receive a second bit of said binary-weighted data word, and an output terminal coupled to said output terminal of said compound data generator.

14. A display driver circuit according to claim 12, wherein said compound data generator comprises:

an output terminal; and an AND gate having a first input terminal coupled to receive a first bit of said binary-weighted data word, a second input terminal coupled to receive a second bit of said binary-weighted data word, and an output terminal coupled to said output terminal of said compound data generator.

15. A display driver circuit according to claim 12, wherein said compound data generator comprises an output terminal coupled to receive a first bit of said binary-weighted data word.

16. A display driver circuit according to claim 12, wherein said compound data generator comprises:

an output terminal; and an OR gate having a first input terminal coupled to receive a first bit of said binary-weighted data word, a second input terminal coupled to receive a second bit of said binary-weighted data word, a third input terminal coupled to receive a third bit of said binary-weighted data word, and an output terminal coupled to said output terminal of said compound data generator.

17. A display driver circuit according to claim 12, wherein said compound data generator comprises:

an output terminal; and an AND gate having a first input terminal coupled to receive a first bit of said binary-weighted data word, a second input terminal coupled to receive a second bit of said binary-weighted data word, and an output terminal; and an OR gate having a first input terminal coupled to receive a third bit of said binary-weighted data word, a second input terminal coupled to said output terminal of said AND gate, and an output terminal coupled to said output terminal of said compound data generator.

18. A display driver circuit according to claim 12, wherein said compound data generator comprises:

an output terminal; and an OR gate having a first input terminal coupled to receive a first bit of said binary-weighted data word, a second input terminal coupled to receive a second bit of said binary-weighted data word, and an output terminal; and an AND gate having a first input terminal coupled to receive a third bit of said binary-weighted data word, a second input terminal coupled to said output terminal of said OR gate, and an output terminal coupled to said output terminal of said compound data generator.

19. A display driver circuit according to claim 12, wherein said compound data generator comprises:

an output terminal; and an AND gate having a first input terminal coupled to receive a first bit of said binary-weighted data word, a second input terminal coupled to receive a second bit of said binary-weighted data word, a third input terminal coupled to receive a third bit of said binary-weighted data word, and an output terminal coupled to said output terminal of said compound data generator.

20. A display driver circuit according to claim 12, wherein said compound data generator comprises:

an input terminal for receiving a first bit and a second bit of said binary-weighted data word;

an output terminal;

a buffer having an input terminal coupled to said input terminal of said compound data generator for receiving said first bit of said binary-weighted data word, and an output terminal, said buffer storing said received first bit of said binary-weighted data word, and asserting said received first bit of said binary-weighted data word on said output terminal of said buffer; and a logic array having a first input terminal coupled to said output terminal of said buffer, a second input terminal coupled to said input terminal of said compound data generator for receiving said second bit of said binary-weighted data word, and a control terminal for receiving control signals, said logic array being configured to selectively assert generated bits of said first group of bits of said compound data word on said output terminal of said compound data generator, responsive to said control signals.

21. A display driver circuit according to claim 20, wherein said logic array comprises:

an OR gate having a first input terminal coupled to said first input terminal of said logic array, a second input terminal coupled to said second input terminal of said logic array, and an output terminal; and a multiplexer having an input terminal coupled to said output terminal of said OR gate, an output terminal coupled to said output terminal of said logic array, and a control terminal for receiving said control signals.

22. A display driver circuit according to claim 20, wherein said logic array comprises:

an AND gate having a first input terminal coupled to said first input terminal of said logic array, a second input terminal coupled to said second input terminal of said logic array, and an output terminal; and a multiplexer having an input terminal coupled to said output terminal of said AND gate, an output terminal coupled to said output terminal of said logic array, and a control terminal for receiving said control signals.

23. A display driver circuit according to claim 20, wherein said logic array comprises a multiplexer having an input terminal coupled to said first input terminal of said logic array, an output terminal coupled to said output terminal of said logic array, and a control terminal for receiving said control signals.

24. A display driver circuit according to claim 12, wherein said compound data generator comprises:

an input terminal for receiving a first bit, a second bit, and a third bit of said binary-weighted data word;

an output terminal;

a first buffer having an input terminal coupled to said input terminal of said compound data generator for receiving said first bit of said binary-weighted data word, and an output terminal, said buffer storing said received first bit of said binary-weighted data word, and asserting said received first bit of said binary-weighted data word on said output terminal of said buffer;

a second buffer having an input terminal coupled to said input terminal of said compound data generator for receiving said second bit of said binary-weighted data word, and an output terminal, said second buffer storing said received second bit of said binary-weighted data word, and asserting said received second bit of said binary-weighted data word on said output terminal of said buffer; and a logic array having a first input terminal coupled to said output terminal of said first buffer, a second input terminal coupled to said output terminal of said second buffer, a third input terminal coupled to said input terminal of said compound data generator for receiving said third bit of said binary-weighted data word, and a control terminal for receiving control signals, said logic array being configured to selectively assert generated bits of said first group of bits of said compound data word on said output terminal of said compound data generator, responsive to said control signals.

25. A display driver circuit according to claim 24, wherein said logic array comprises:

an OR gate having a first input terminal coupled to said first input terminal of said logic array, a second input terminal coupled to said second input terminal of said logic array, a third input terminal coupled to said third input terminal of said logic array, and an output terminal; and a multiplexer having an input terminal coupled to said output terminal of said OR gate, an output terminal coupled to said output terminal of said logic array, and a control terminal for receiving said control signals.

26. A display driver circuit according to claim 24, wherein said logic array comprises:

an OR gate having a first input terminal coupled to said first input terminal of said logic array, a second input terminal coupled to said second input terminal of said logic array, and an output terminal; and a multiplexer having an input terminal coupled to said output terminal of said OR gate, an output terminal coupled to said output terminal of said logic array, and a control terminal for receiving said control signals.

27. A display driver circuit according to claim 24, wherein said logic array comprises:

an AND gate having a first input terminal coupled to said second input terminal of said logic array, a second input terminal coupled to said third input terminal of said logic array, and an output terminal;

an OR gate having a first input terminal coupled to said first input terminal of said logic array, a second input terminal coupled to said output terminal of said AND gate, and an output terminal; and a multiplexer having an input terminal coupled to said output terminal of said OR gate, an output terminal coupled to said output terminal of said logic array, and a control terminal for receiving said control signals.

28. A display driver circuit according to claim 24, wherein said logic array comprises:

an OR gate having a first input terminal coupled to said second input terminal of said logic array, a second input terminal coupled to said third input terminal of said logic array, and an output terminal;

an AND gate having a first input terminal coupled to said first input terminal of said logic array, a second input terminal coupled to said output terminal of said OR gate, and an output terminal; and a multiplexer having an input terminal coupled to said output terminal of said AND gate, an output terminal coupled to said output terminal of said logic array, and a control terminal for receiving said control signals.

29. A display driver circuit according to claim 24, wherein said logic array comprises:

an AND gate having a first input terminal coupled to said first input terminal of said logic array, a second input terminal coupled to said second input terminal of said logic array, and an output terminal; and a multiplexer having an input terminal coupled to said output terminal of said AND gate, an output terminal coupled to said output terminal of said logic array, and a control terminal for receiving said control signals.

30. A display driver circuit according to claim 24, wherein said logic array comprises:

an AND gate having a first input terminal coupled to said first input terminal of said logic array, a second input terminal coupled to said second input terminal of said logic array, a third input terminal coupled to said third input terminal of said logic array, and an output terminal; and a multiplexer having an input terminal coupled to said output terminal of said AND gate, an output terminal coupled to said output terminal of said logic array, and a control terminal for receiving said control signals.

31. A display driver circuit according to claim 24, wherein said logic array comprises a multiplexer having an input terminal coupled to said first input terminal of said logic array, an output terminal coupled to said output terminal of said logic array, and a control terminal for receiving said control signals.

32. A display driver circuit according to claim 12, wherein said compound data generator is configured to convert a first set of the (X) most significant bits of said binary-weighted data word to $(2^X-1)$ bits.

33. A display driver circuit according to claim 32, wherein the value of said compound data word is equal to the value of said binary-weighted data word.

34. A method for asserting a compound data word on a display pixel, said compound data word corresponding to a particular pixel value and including a first group of bits and a second group of bits, said method comprising the steps of:

receiving a data word of a first type;

generating said compound data word from said data word of said first type by converting at least one bit of said data word of said first type into said first group of data bits, and including at least one other data bit of said data word of said first type in said second group of data bits;

asserting each said bit of said first group of bits on said display pixel for a coequal time period; and asserting each bit of said second group of bits on said display pixel for a differing time period dependent on an associated significance of each said bit, whereby an output of said pixel corresponds to said value of said compound data word.

35. A method for asserting a compound data word on a display pixel according to claim 34, wherein each bit of said first group is asserted on said display pixel for a time period twice the duration of said time period dependent on the significance of a most significant bit of said second group of bits.

36. A method for asserting a compound data word on a display pixel according to claim 34, wherein said step of generating said compound data word from said data word of said first type comprises performing a mathematical operation on said data word of said first type.

37. A method for asserting a compound data word on a display pixel according to claim 34, wherein said step of generating said compound data word from said data word of said first type comprises retrieving said compound data word from a memory location indicated by said data word of said first type.

38. A method for asserting a compound data word on a display pixel according to claim 34, wherein said step of generating said compound data word from said data word of said first type comprises retrieving said compound data word from a look-up-table location indicated by said data word of said first type.

39. A method for asserting a compound data word on a display pixel according to claim 34, wherein said data word of said first type is a binary-weighted data word.

40. A method for asserting a compound data word on a display pixel according to claim 39, wherein:

said binary-weighted data word is capable of defining a first number of values; and said compound data word is capable of defining a second number of values, said first number of values being greater than said second number of values.

41. A method for asserting a compound data word on a display pixel according to claim 40, wherein said value of said compound data word is the one of said second number of values nearest said value of said binary-weighted data word.

42. A method for asserting a compound data word on a display pixel according to claim 40, wherein said step of generating said compound data word includes calculating said value (Vc) of said compound data word from the formula Vc=INT(GC/N), where G represents said value of said binary-weighted data word, C represents said second number of values of said compound data word, N represents said first number of values of said binary-weighted data word, and INT represents the integer function.

43. A method for asserting a compound data word on a display pixel, said compound data word corresponding to a particular pixel value and including a first group of bits and a second group of bits, said method comprising the steps of:

receiving a binary-weighted data word;

generating said compound data word from said binary-weighted data word, said step of generating said compound data word from said binary-weighted data word comprising the step of converting at least one bit of said binary-weighted data word into said first group of bits of said compound data word;

asserting each said bit of said first group of bits on said display pixel for a coequal time period; and asserting each bit of said second group of bits on said display pixel for a differing time period dependent on an associated significance of each said bit, whereby an output of said pixel corresponds to said value of said compound data word.

44. A method for asserting a compound data word on a display pixel according to claim 43, wherein said step of converting said at least one bit of said binary-weighted data word into said first group of bits of said compound data word comprises the step of converting a first set of the (X) most significant bits of said binary-weighted data word into $(2^X-1)$ bits.

45. A method for asserting a compound data word on a display pixel according to claim 44, wherein the value of said compound data word is equal to the value of said binary-weighted data word.

46. A method for generating a compound data word comprising the steps of:

receiving a data word of a first type;

providing a first group of data bits, said bits of said first group being of like significance with respect to each other, and being generated from a first subset of data bits of said data word of said first type; and providing a second group of data bits, said bits of said second group differing in significance with respect to each other, and being a second subset of data bits of said data word of said first type.

47. A method for generating a compound data word according to claim 46, wherein at least one of said steps of providing said first group of data bits and providing said second group of data bits comprises performing a mathematical operation on said data word of said first type.

48. A method for generating a compound data word according to claim 46, wherein at least one of said steps of providing said first group of data bits and providing said second group of data bits comprises retrieving at least one of said first group of data bits and said second group of data bits from a memory location indicated by said data word of said first type.

49. A method for generating a compound data word according to claim 46, wherein at least one of said steps of providing said first group of data bits and providing said second group of data bits comprises retrieving at least one of said first group of data bits and said second group of data bits from a look-up-table location indicated by said data word of said first type.

50. A method for generating a compound data word according to claim 46, wherein said data word of said first type is a binary-weighted data word.

51. A method for generating a compound data word according to claim 50, wherein:

said data word of said first type is capable of defining a first number of values; and said compound data word is capable of defining a second number of values, said first number of values being greater than said second number of values.

52. A method for generating a compound data word according to claim 51, wherein said value of said compound data word is the one of said second number of values nearest to said value of said binary-weighted data word.

53. A method for generating a compound data word according to claim 51, wherein said steps of providing said first group of data bits and said second group of data bits includes calculating said value of said compound data word (Vc) from the formula Vc=INT(GC/N), where G represents said value of said binary-weighted data word, C represents said second number of values, N represents said first number of values, and INT represents the integer function.

54. A method for generating a compound data word comprising the steps of:

receiving a binary-weighted data word;

providing a first group of data bits, said bits of said first group being of like significance with respect to each other; and providing a second group of data bits, said bits of said second group differing in significance with respect to each other; and wherein;

at least one of said first group of data bits and said second group of data bits are provided in response to receipt of said binary-weighted data word; and said step of providing said first group of data bits comprises converting at least one bit of said binary-weighted data word into said first group of bits.

55. A method for generating a compound data word according to claim 54, wherein said step of converting said at least one bit of said binary-weighted data word into said first group of data bits comprises:

receiving a first binary-weighted data bit;

receiving a second binary weighted data bit; and performing a logical OR operation on said first binary weighted data bit and said second binary weighted data bit to generate one bit of said first group of bits.

56. A method for generating a compound data word according to claim 54, wherein said step of converting said at least one bit of said binary-weighted data word into said first group of data bits comprises:

receiving a first binary-weighted data bit;

receiving a second binary weighted data bit; and performing a logical AND operation on said first binary weighted data bit and said second binary weighted data bit to generate one bit of said first group of bits.

57. A method for generating a compound data word according to claim 54, wherein said step of converting said at least one bit of said binary-weighted data word into said first group of data bits comprises:

receiving a first binary-weighted data bit;

setting one bit of said first group of bits equal to said first binary weighted data bit to generate said one bit of said first group of bits.

58. A method for generating a compound data word according to claim 54, wherein said step of converting said at least one bit of said binary-weighted data word into said first group of data bits comprises:

receiving a first binary-weighted data bit;

receiving a second binary weighted data bit;

receiving a third binary weighted data bit; and performing a logical OR operation on said first binary weighted data bit, said second binary weighted data bit, and said third binary-weighted data bit to generate one bit of said first group of bits.

59. A method for generating a compound data word according to claim 54, wherein said step of converting said at least one bit of said binary-weighted data word into said first group of data bits comprises:

receiving a first binary-weighted data bit;

receiving a second binary weighted data bit;

receiving a third binary weighted data bit; and performing a logical AND operation on said first binary weighted data bit, said second binary weighted data bit, and said third binary-weighted data bit to generate one bit of said first group of bits.

60. A method for generating a compound data word according to claim 54, wherein said step of converting said at least one bit of said binary-weighted data word into said first group of data bits comprises:

receiving a first binary-weighted data bit;

receiving a second binary weighted data bit;

receiving a third binary weighted data bit;

performing a logical OR operation on said second binary weighted data bit and said third binary weighted data bit; and performing a logical AND operation on said first binary weighted data bit and the product of said logical OR operation to generate one bit of said first group of bits.

61. A method for generating a compound data word according to claim 54, wherein said step of converting said at least one bit of said binary-weighted data word into said first group of data bits comprises:

receiving a first binary-weighted data bit;

receiving a second binary weighted data bit;

receiving a third binary weighted data bit;

performing a logical AND operation on said second binary weighted data bit and said third binary weighted data bit; and performing a logical OR operation on said first binary weighted data bit and the product of said logical OR operation to generate one bit of said first group of bits.

62. A method for generating a compound data word according to claim 54, wherein said step of converting said at least one bit of said binary-weighted data word into said first group of data bits comprises the step of converting a first set of the (X) most significant bits of said binary-weighted data word into $(2^X-1)$ bits.

63. A method for generating a compound data word according to claim 62, wherein the value of said compound data word is equal to the value of said binary-weighted data word.

64. A compound data word generator configured to produce a set of compound data words, each compound data word of said set representing a display pixel intensity value and having a maximum phase difference Ød with respect to other compound data words representing adjacent intensity values in said set, where $$Ød = \frac{2^{m+1} - 1}{2^m(n+1) - 1},$$

(m) representing the number of equally-weighted bits in each said compound data word and (n) representing the number of binary-weighted bits in each said compound data word.

65. A projector comprising:

a display including a plurality of pixels; and a driver circuit, coupled to said display, for writing a compound data word to said display, said compound data word comprising a first group of data bits and a second group of data bits, said driver circuit comprising a compound data word generator configured to receive a data word of a first type, to convert at least one bit of said data word of said first type into said first group of data bits, to include at least one other bit of said data word of said first type in said second group of data bits, and to provide said compound data word at an output; and an output controller configured to provide display control signals, said display control signals causing each bit of said first group of data bits to be asserted on one of said pixels for a coequal time period, and causing each bit of said second group of data bits to be asserted on said one of said pixels for a time period dependent on an associated significance of each said bit.

* * * * *